US011027881B2

(12) United States Patent
Edwards et al.

(10) Patent No.: US 11,027,881 B2
(45) Date of Patent: Jun. 8, 2021

(54) PLASTIC PALLET HAVING AN INTEGRALLY FORMED DECK AND METHOD OF MANUFACTURING THE SAME

(71) Applicant: iGPS Logistics LLC, Orlando, FL (US)

(72) Inventors: Thomas Edwards, Orlando, FL (US); Ellwood P. Hunt, III, Orlando, FL (US); Dan Gorsky, Mason, OH (US); Robert States, III, Mason, OH (US); Jacob Huizenga, Orlando, FL (US); Bruce M. Torrey, Orlando, FL (US)

(73) Assignee: iGPS Logistics, LLC, Orlando, FL (US)

( * ) Notice: Subject to any disclaimer, the term of this patent is extended or adjusted under 35 U.S.C. 154(b) by 0 days.

(21) Appl. No.: 16/527,932

(22) Filed: Jul. 31, 2019

(65) Prior Publication Data

US 2020/0039686 A1 Feb. 6, 2020

Related U.S. Application Data

(60) Provisional application No. 62/712,272, filed on Jul. 31, 2018.

(51) Int. Cl.
*B65D 19/00* (2006.01)

(52) U.S. Cl.
CPC ..... *B65D 19/0032* (2013.01); *B65D 2519/00034* (2013.01); *B65D 2519/00069* (2013.01);
(Continued)

(58) Field of Classification Search
CPC ..... B65D 19/0032; B65D 19/00; B65D 2519/00034; B65D 2519/00069;
(Continued)

(56) References Cited

U.S. PATENT DOCUMENTS 5,413,052 A * 5/1995 Breezer ..... B65D 19/0012 108/56.1
5,868,080 A * 2/1999 Wyler ..... B65D 19/0022 108/57.25

(Continued)

FOREIGN PATENT DOCUMENTS

EP 2628686 A1 8/2013

OTHER PUBLICATIONS

International Search Report and Written Opinion for International Application No. PCT/US19/44439, dated Oct. 24, 2019, nine (9) pages.

*Primary Examiner* — Jose V Chen
(74) *Attorney, Agent, or Firm* — Greenberg Traurig, LLP

(57) ABSTRACT

A reinforced plastic pallet includes an integrally formed deck having a top deck surface, a bottom deck surface, and a plurality of spaced apart supports extending between the top deck surface and the bottom deck surface. The top deck surface has a plurality of outwardly extending top ribs extending from the top deck surface and the bottom deck surface has a plurality of outwardly extending bottom ribs extending from the bottom deck surface. A top sheet is coupled to the top deck surface to fully enclose the top ribs between the top sheet and the top deck surface. A bottom sheet is coupled to the bottom deck surface and encloses the bottom ribs between the bottom sheet and the bottom deck surface. The pallet may include optional reinforcement rods fully contained within channels formed in the ribs.

17 Claims, 27 Drawing Sheets

(52) U.S. Cl.
CPC ..... *B65D 2519/00288* (2013.01); *B65D 2519/00318* (2013.01); *B65D 2519/00343* (2013.01); *B65D 2519/00467* (2013.01); *B65D 2519/00472* (2013.01)

(58) Field of Classification Search
CPC ..... B65D 2519/00104; B65D 2519/00119; B65D 2519/00139; B65D 2519/00208; B65D 2519/00398
USPC ..... 108/57.25
See application file for complete search history.

(56) References Cited

U.S. PATENT DOCUMENTS 6,199,488 B1 * 3/2001 Favaron ..... B65D 19/0012 108/57.25
6,758,148 B2 * 7/2004 Torrey ..... B65D 19/0004 108/51.11
6,807,910 B2 * 10/2004 Apps ..... B65D 19/0012 108/57.25
7,086,339 B2 * 8/2006 Apps ..... B65D 19/0012 108/57.25
7,661,373 B2 * 2/2010 Apps ..... B65D 19/0012 108/56.3
8,584,599 B2 11/2013 Sosa Bravo
8,770,115 B2 * 7/2014 Apps ..... B65D 19/0004 108/57.25
8,943,981 B2 2/2015 Kelly
9,038,273 B2 * 5/2015 Grgac ..... B23P 11/00 29/897.1
9,452,864 B2 * 9/2016 Apps ..... B29C 45/0003
9,714,116 B2 * 7/2017 Rader ..... B65D 19/0016
10,118,731 B2 * 11/2018 Apps ..... B65D 19/0069
2001/0029874 A1 * 10/2001 Muirhead ..... B65D 19/38 108/57.25
2002/0112653 A1 8/2002 Moore, Jr. et al.
2003/0075081 A1 * 4/2003 Apps ..... B65D 19/0012 108/56.3
2005/0145145 A1 * 7/2005 Ogburn ..... B65D 19/18 108/57.25
2006/0201402 A1 * 9/2006 Moore, Jr. ..... B65D 19/0038 108/57.25
2007/0163473 A1 * 7/2007 Shuert ..... B65D 19/0016 108/57.25
2008/0210140 A1 * 9/2008 Valentinsson ..... B65D 19/0014 108/57.25
2008/0295748 A1 * 12/2008 Yoshida ..... B65D 19/0026 108/55.1
2009/0000527 A1 * 1/2009 Ficker ..... B65D 19/0016 108/57.25
2009/0188412 A1 * 7/2009 Dubois ..... B65D 19/0022 108/57.25
2011/0120353 A1 5/2011 Jensen et al.
2011/0174198 A1 7/2011 Seger
2012/0160734 A1 * 6/2012 Linares ..... B65D 19/0028 206/596
2013/0220184 A1 * 8/2013 Apps ..... B65D 19/0014 108/56.1
2016/0075470 A1 * 3/2016 Liao ..... B65D 19/0095 108/54.1
2017/0021963 A1 1/2017 Apps et al.
2018/0141710 A1 * 5/2018 Storteboom ..... B65D 19/0016
2018/0322453 A1 * 11/2018 Lantz ..... G06Q 10/087
2018/0339802 A1 * 11/2018 Lenz ..... B65D 19/0026
2018/0339803 A1 * 11/2018 Hawley ..... B65D 19/0095
2019/0135485 A1 * 5/2019 Apps ..... B65D 19/0036
2019/0359378 A1 * 11/2019 White ..... B65D 19/0073
2019/0367215 A1 * 12/2019 D'Emidio ..... B65D 19/0016

* cited by examiner

PLASTIC PALLET HAVING AN INTEGRALLY FORMED DECK AND METHOD OF MANUFACTURING THE SAME

CROSS REFERENCE TO RELATED APPLICATION

This application is a non-provisional application claiming priority from U.S. Provisional Application Ser. No. 62/712,272, filed Jul. 31, 2018, and incorporated herein by reference in its entirety.

FIELD OF THE DISCLOSURE

The present description relates generally to plastic pallets and more particularly to a plastic pallet having an integrally formed injection molded deck and method of manufacturing the same.

BACKGROUND OF RELATED ART

Various plastic pallets are well known in the art. For example, EP 2628686 describes a pallet and a method for assembling and disassembling a pallet formed of two identical plastic material half pallet members assembled to each other in face to face relationship by interlocking snap-fit latches. Each half pallet includes a first row of hollow posts disposed on its first lateral side, a second row of support legs disposed on its second lateral side and a third central row of half hollow posts integral with half support legs disposed opposite to the half hollow posts with regard to said central axis of the pallet. The snap-fit latches are formed by protruding parts arranged to snap in corresponding holes and are disconnectable with a tool.

In another example, U.S. Pat. No. 8,943,981 describes a reinforced plastic pallet including a top deck and a bottom deck supported in spaced apart relationship by a plurality of post assemblies. A reinforcement assembly is encapsulated within at least one of the top or bottom deck. The reinforcement assembly includes at least one reinforcement rod having opposed ends and a plurality of reinforcement caps.

Finally, in another example, U.S. Pat. No. 8,584,599 describes a plastic pallet that is formed from two pieces, namely a base and a deck that can be coupled to each other with fasteners therebetween. The base and deck are provided with posts each projecting in a direction towards the other and able to be coupled to each other in order to form hollow columns. The posts projecting from the base form the outer wall of a plurality of columns, and the posts projecting from the deck are located at the interior of the columns, forming the inner wall thereof and thus constituting a hollow passage between the outer and inner walls of the columns. The hollow space is filled up with a foamed material to provide a greater impact resistance and resistance to disassembly under normal conditions of operation.

While the above pallets may be generally suitable for their intended purposes, there is an identifiable need for an improved plastic pallet construction with a unitary deck as disclosed herein.

DETAILED DESCRIPTION

The following description of example methods and apparatus is not intended to limit the scope of the description to the precise form or forms detailed herein. Instead the following description is intended to be illustrative so that others may follow its teachings.

Figure 1:
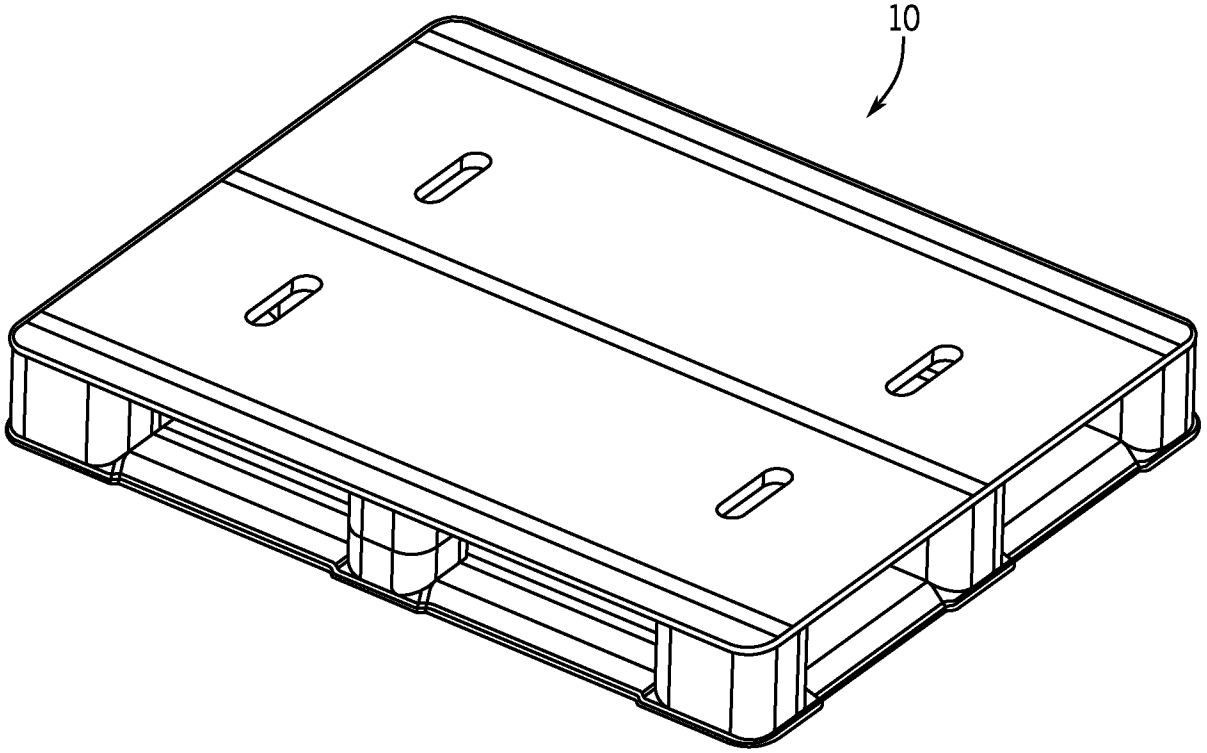
FIG. 1 is a top, perspective view of an example plastic pallet constructed in accordance with the teachings of the present disclosure.
Figure 2:
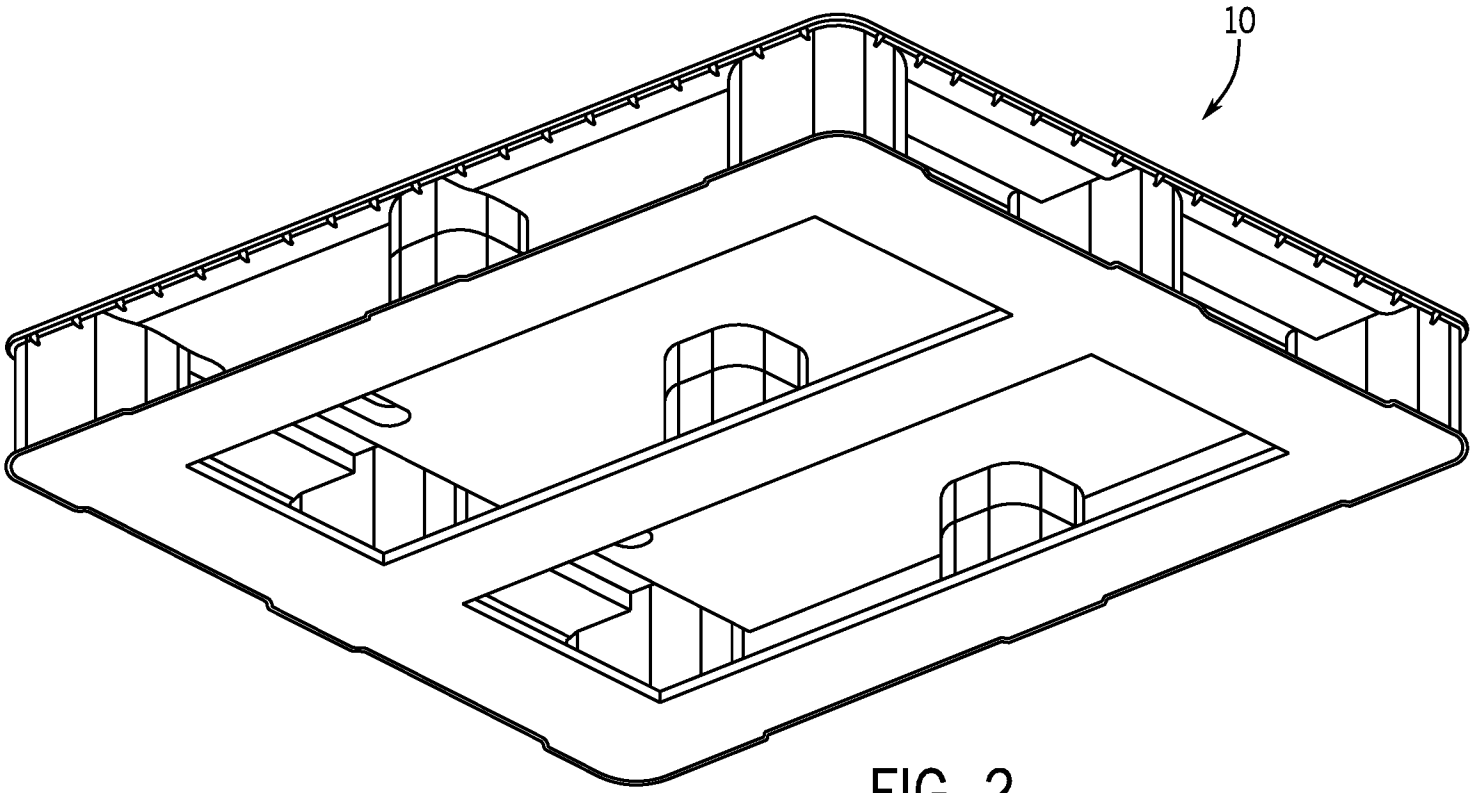
FIG. 2 is a bottom, perspective view of the example pallet of FIG. 1.
Figure 3:
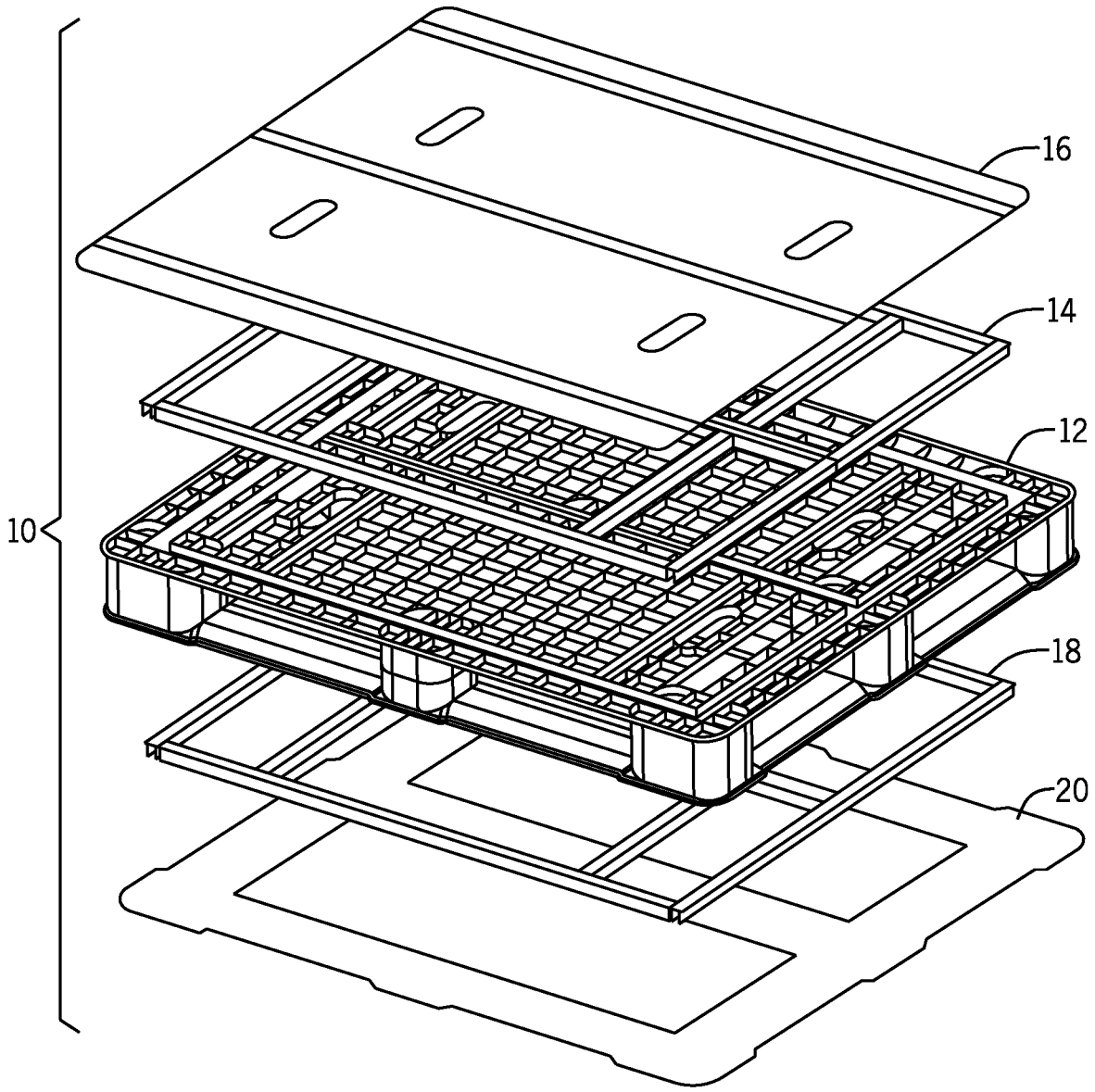
FIG. 3 is an exploded, perspective view of the example pallet of FIG. 1.

Referring now to FIGS. 1-11B, an example plastic pallet 10 is illustrated and disclosed. FIGS. 1 and 2 illustrate a top and bottom perspective view of the fully assembled pallet 10. As disclosed, the example plastic pallet 10 has an integrally formed deck 12. More precisely, as illustrated in FIG. 3, the example plastic pallet includes the deck 12, a top reinforcement rod assembly 14, a top sheet 16, a bottom reinforcement rod assembly 18, and a bottom sheet 20. In the present example, the deck 12 is molded as a single monolithic member and more precisely, the example deck 12 is a single piece injection molded deck.

As completely assembled, the pallet 10 is fully encapsulated and is compliant with NSF International standards. By being encapsulated, the pallet 10 may reduce any opportunity for insect and/or creature intrusion and may minimize any opportunity for liquids, such as spills, washing fluids, etc. to collect or pool. Thus, the encapsulated pallet 10 is increasingly insect resistant, easily washable, etc. More particularly, the deck 12 is provided with the example reinforcement rod assemblies 14, 20, comprising a plurality of reinforcement rods, such as pi-shaped rods shown in FIGS. 11A and 11B, to optionally reinforce either or both of the top and bottom of the deck 12. For instance, the reinforcement rods 14, 20 may be formed from any suitable substantially rigid material, such as for example a metal, carbon fiber, etc. Finally, the top sheet 16 and the bottom sheet 20 are permanently or semi-permanently attached to the deck 12 to enclose the surfaces of the deck 12 and to seat the reinforcement rod assemblies 14, 20, by any suitable process, including for instance, hot plate welding.

Figure 4:
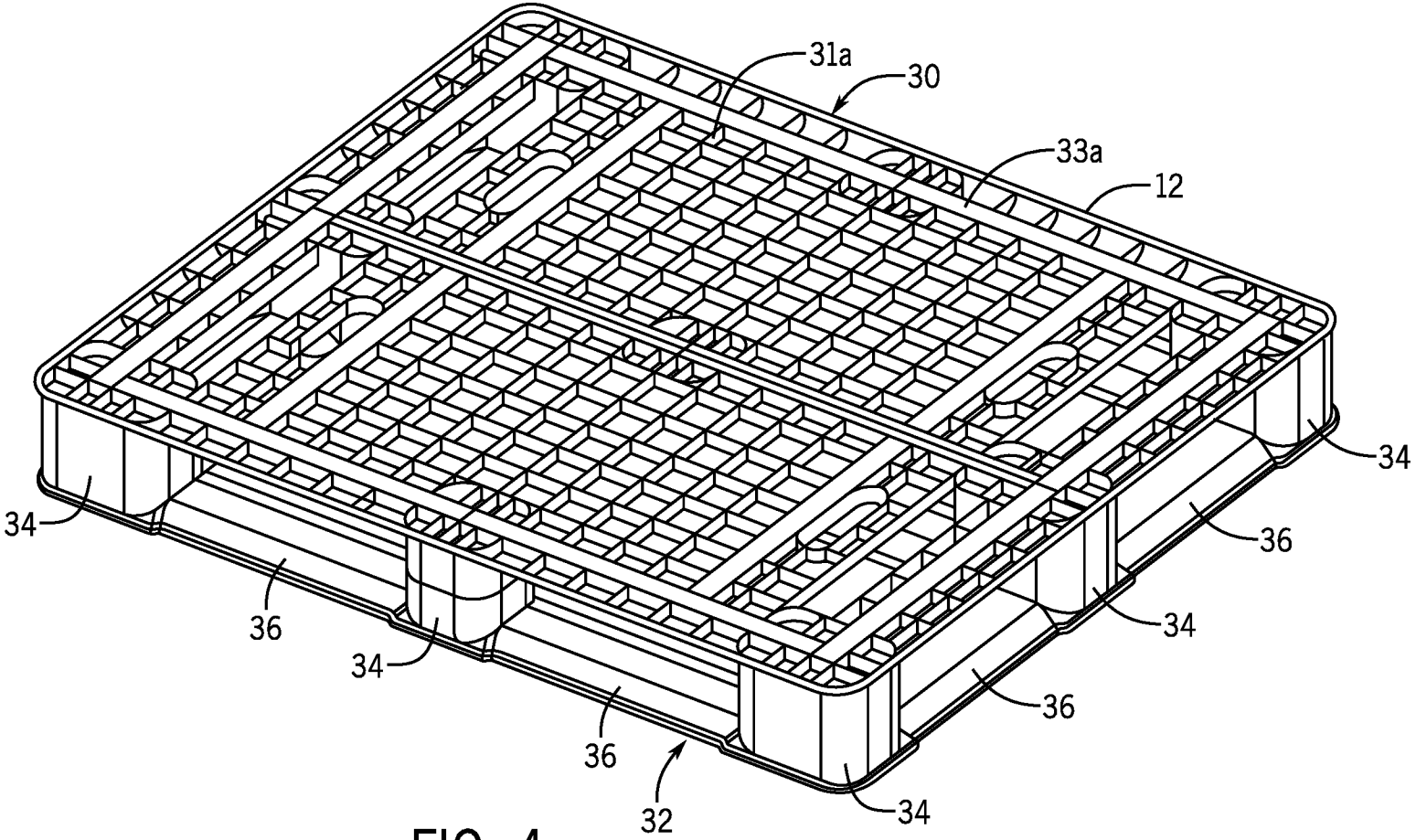
FIG. 4 is a top, perspective view of an example integrally formed injection molded deck for use in the example pallet of FIG. 1.
Figure 5:
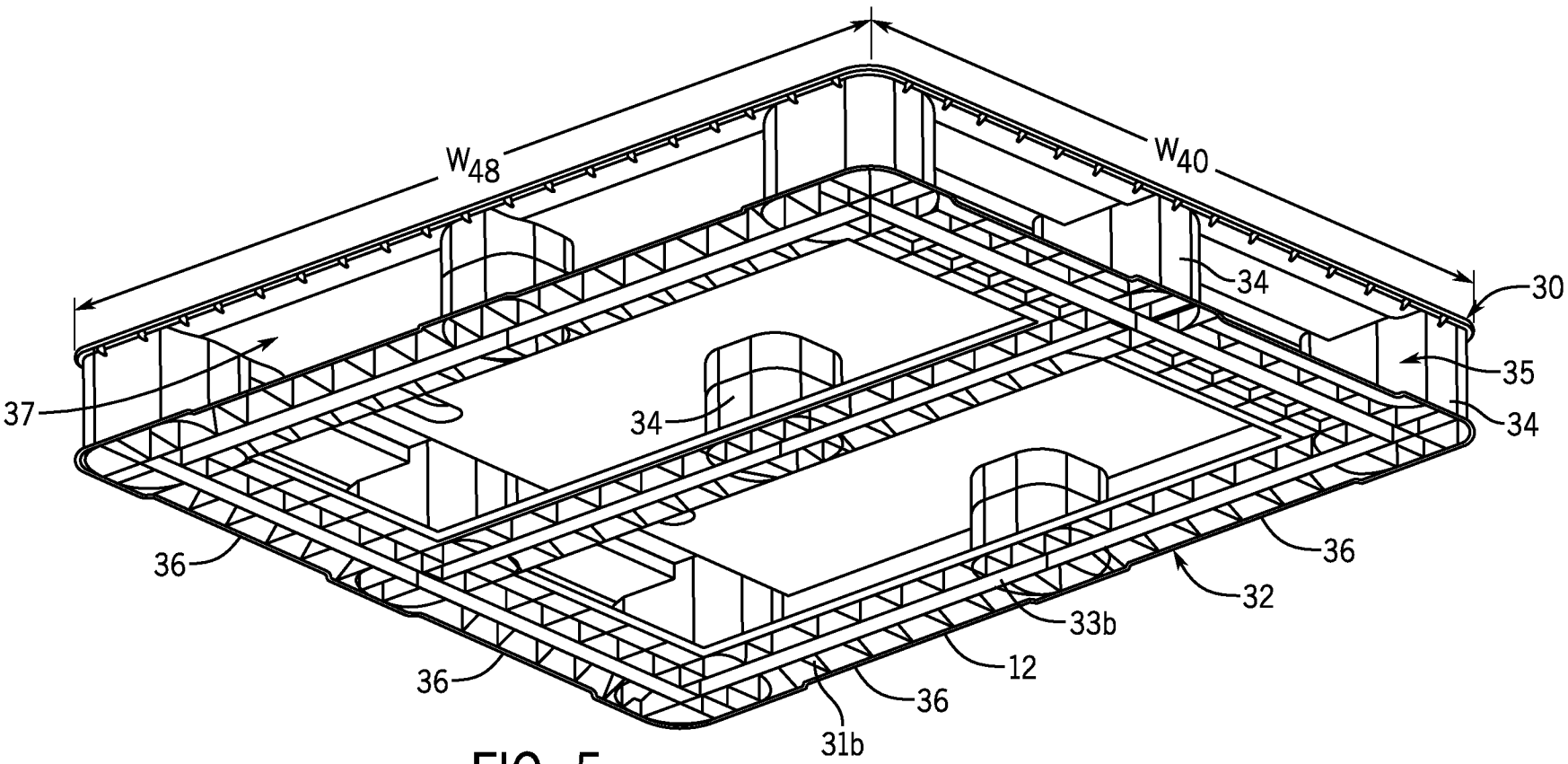
FIG. 5 is a bottom, perspective view of the example integrally formed injection molded deck of FIG. 4.

Referring to FIGS. 4 and 5, the example deck 12 of the pallet 10 includes a top deck surface 30 having a generally rectangular shape, a bottom deck surface 32 having a generally rectangular perimeter shape, and a plurality of spaced apart supports 34 coupled at the corners and mid-section between the top deck surface 30 and the bottom deck surface 32, forming a gap therebetween for receiving a lifting member, such as the forks of an electric pallet jack (EPJ). By utilizing a single piece injection molded deck 12 to make the design more durable and resistant to deformations, the gap opening is, in this example, larger than the gap of similar multi-piece deck assemblies. A plurality of deck boards or stringers 36 extend between the supports 34. In this example, the stringers 36 include chamfers 39 on the leading and trailing edges to allow easier access over the stringers 36 by the lifting member. For example, a typical EPJ includes a wheeled support fork and the chamfers 39 allow the wheels of the EPJ to be inserted and removed more easily. In one example, the chamfer is approximately 21° (see FIG. 6B).

As shown in FIG. 5, with a typical 40 inch span ($W_{40}$), the width of a formed aperture 35 is 12.2 inches, while the height of the formed aperture 35 is 3.75 inches. Similarly, with a typical 48 inch span ($W_{48}$), the width of a formed aperture 37 is 14.2 inches, while the height of the formed aperture is 3.75 inches.

Figure 6A:
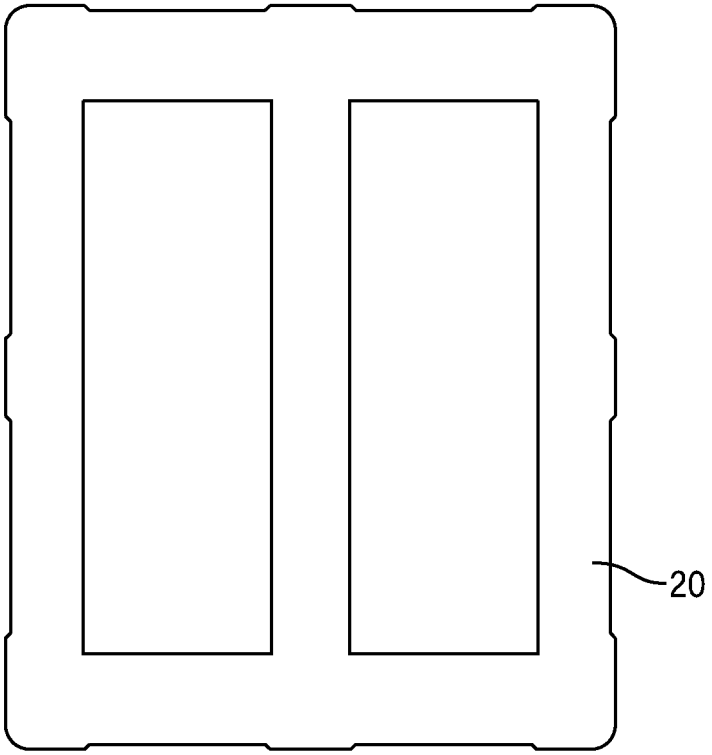
FIG. 6A is a top plan view of an example bottom sheet for use in the example pallet of FIG. 1.
Figure 6B:
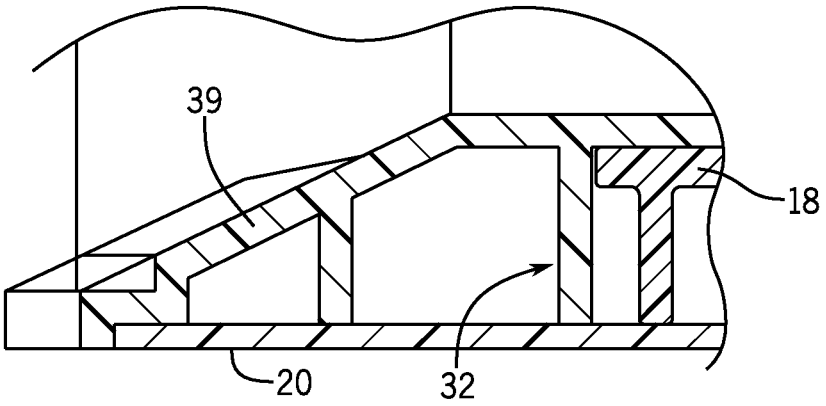
FIG. 6B is an enlarged cross section of the example bottom sheet of FIG. 6A as assembled with the example deck of FIG. 4.
Figure 7A:
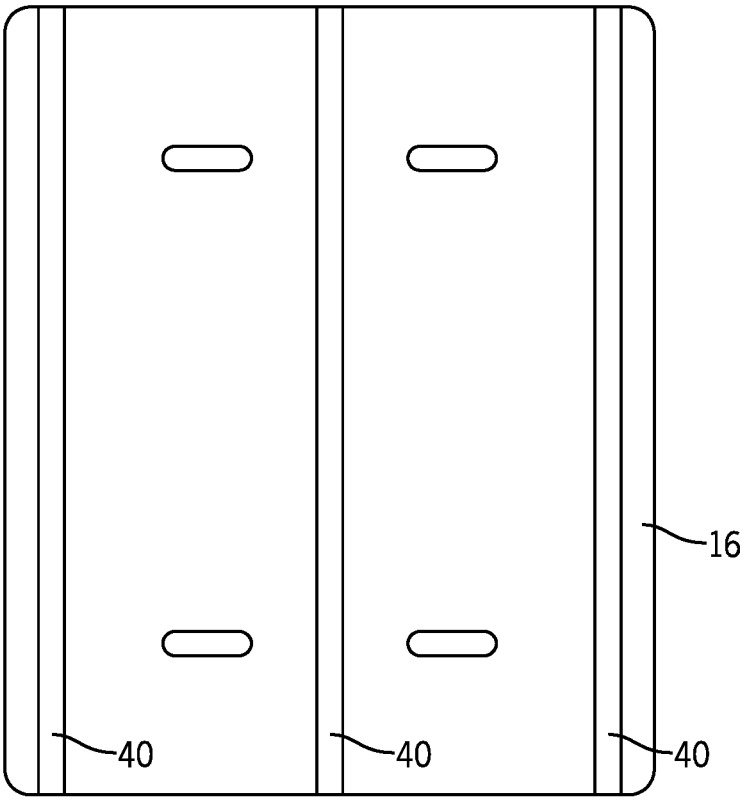
FIG. 7A is a top plan view of an example top sheet for use in the example pallet of FIG. 1.
Figure 7B:
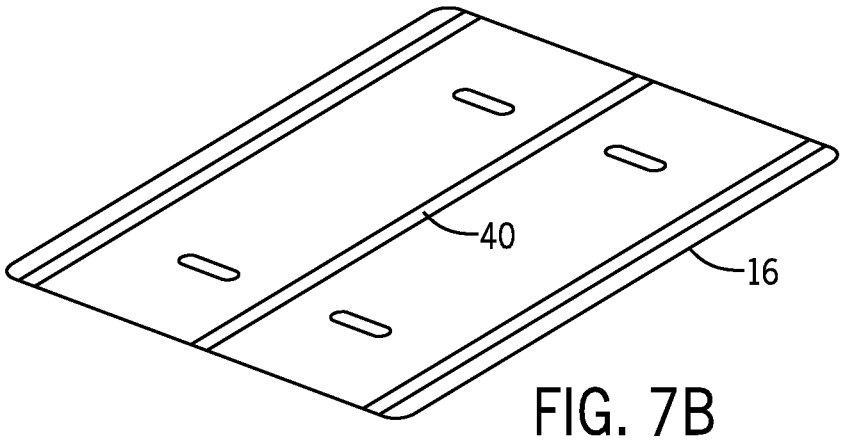
FIG. 7B is a perspective view of the top sheet of FIG. 7A.
Figure 7C:
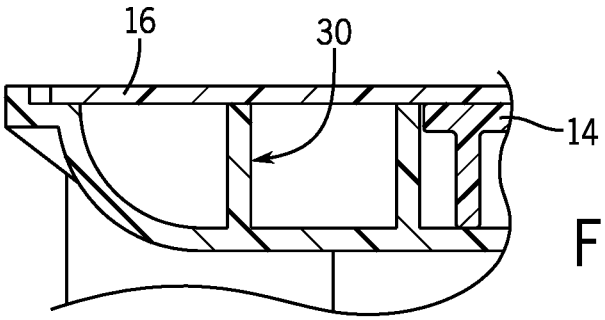
FIG. 7C is an enlarged cross section of the example top sheet of FIG. 7A as assembled with the example deck of FIG. 4.
Figure 8A:
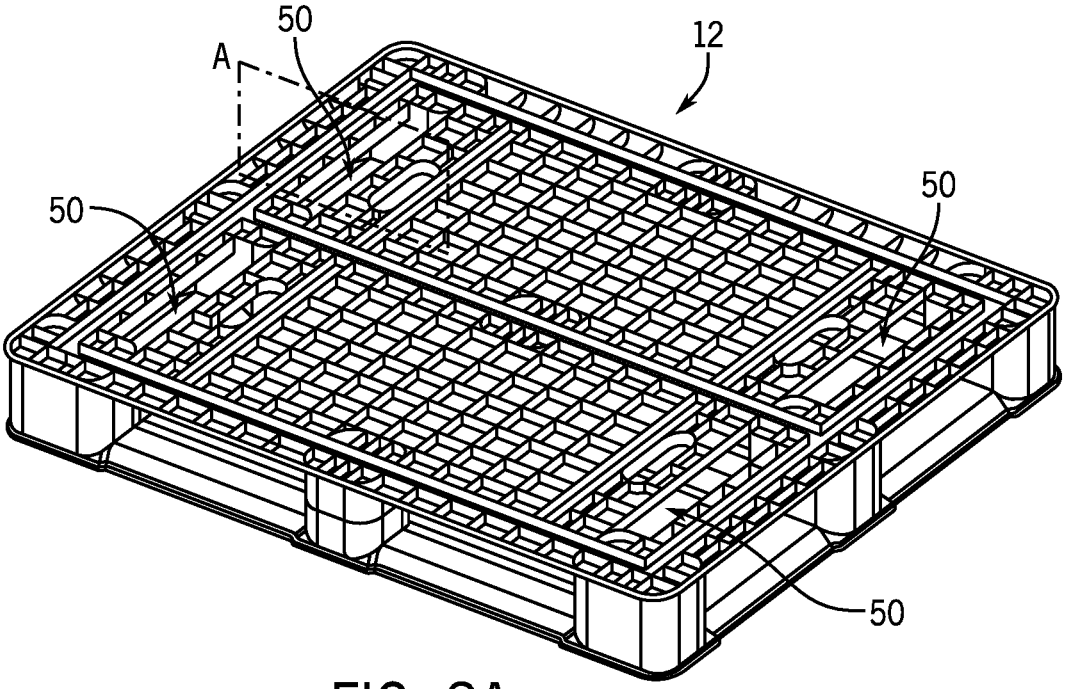
FIG. 8A is a top, perspective view of the example deck of FIG. 4.
Figure 8B:
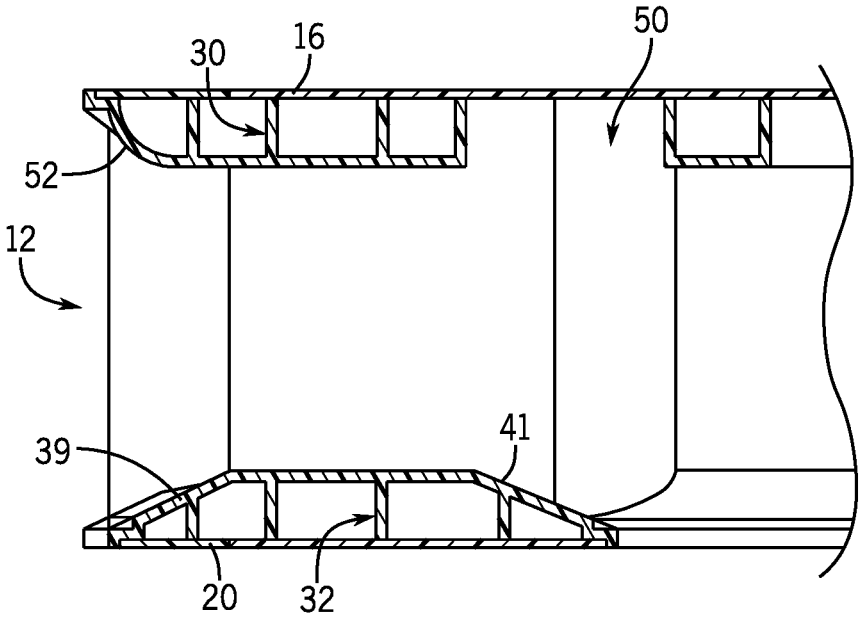
FIG. 8B is an enlarged cross-sectional view of the example deck taken along rectangle A-A of FIG. 8A.

As can be seen in FIGS. 4 and 5, each of the top deck surface 30 and the bottom deck surface 32 of the molded deck 12 includes a plurality of channels, voids, valleys, etc formed in this example by a plurality of outwardly extending ribs 31*a*, 31*b*, extending generally perpendicular from the top deck surface 30 and the bottom deck surface 32, respectively. The top reinforcement rod assembly 14 is placed within one of the channels 33*a* in the top deck surface 30, while the bottom reinforcement rod assembly 18 is placed within one of the channels 33*b* in the bottom deck surface 32 (see FIG. 10). To enclose the noted spaces and the respective reinforcement rod assemblies 14, 18, the top sheet 16 is coupled to the top deck surface 30 and the bottom sheet 20 is coupled to the bottom deck surface 32. As illustrated in FIGS. 6A and 6B, the bottom sheet 20 is welded to the bottom deck surface 32 and as illustrated in FIGS. 7A-7C, the top sheet 16 is welded to the top deck surface 30, although any suitable coupling method may be utilized. Also as illustrated in FIGS. 7A and 7B, the example top sheet 16 includes at least one grip surface 40, such as a Thermoplastic Elastomer (TPE), which may be coextruded or otherwise coupled, attached, and/or mounted to the top sheet 16. As will be appreciated, a similar TPE or other grip surface may be provided on the example bottom sheet 20. The grip surface 40 thus provides a coefficient of friction that differs from that of the material from which the top sheet 16 and the bottom sheet 20 are formed and in one example, the grip surface 40 associated with the top sheet 16 may have a coefficient of friction that differs from that of the grip surface 40 associated with the bottom sheet 20. For instance, in one example, the grip surfaces 40 would have an approximate dimension of L 47"×W 2"×H 1/16".

Figure 9A:
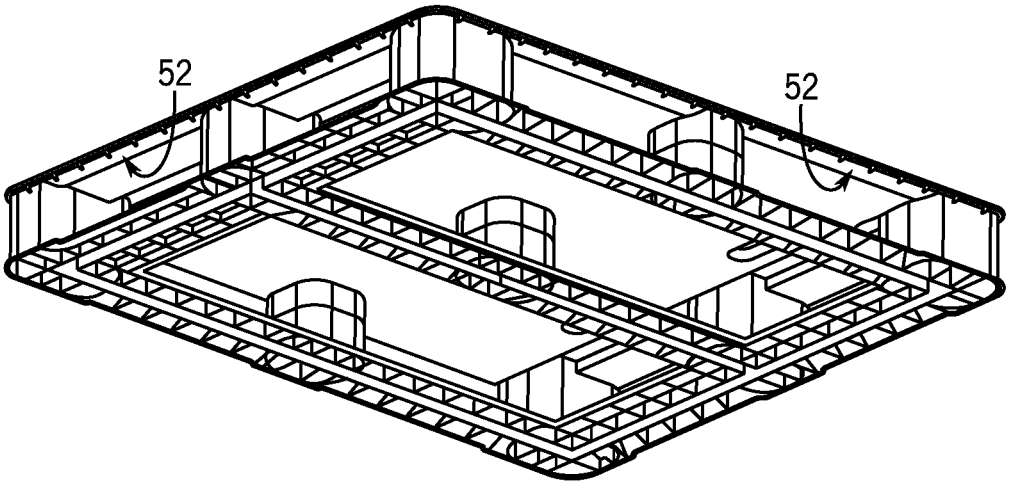
FIG. 9A is a bottom, perspective view of the example deck of FIG. 4, showing the location of various radiused perimeters.
Figure 9B:
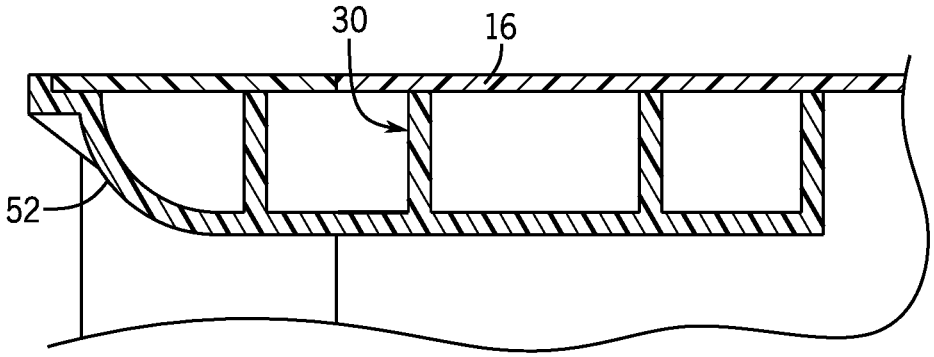
FIG. 9B is an enlarged cross-sectional view of the identified radiused perimeters of FIG. 9A.
Figure 10:
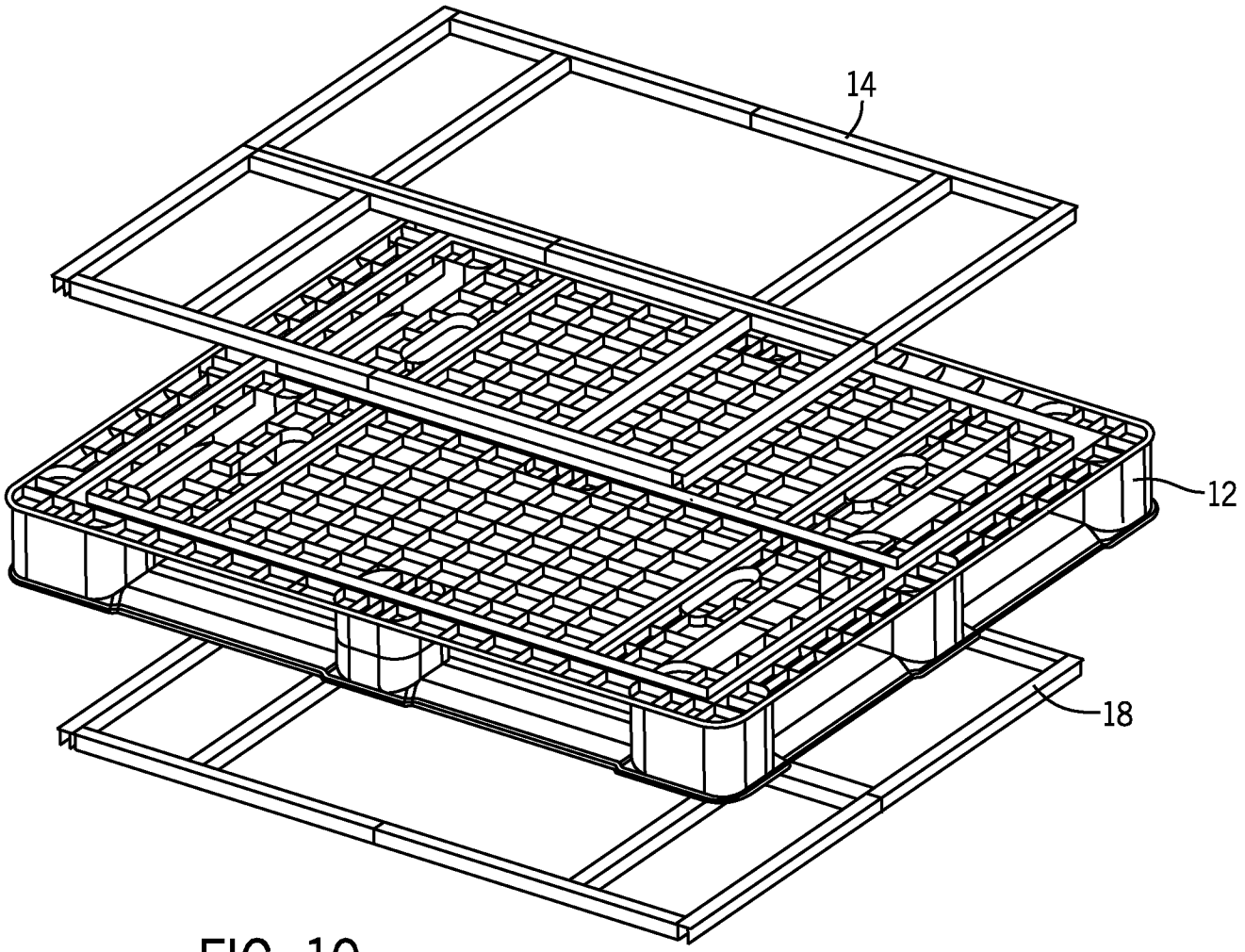
FIG. 10 is an exploded perspective view of the example deck of FIG. 4 including example reinforcement rods.

As shown in FIGS. 8A-9B, the deck 12 includes various features. For instance, as mentioned above, the deck 12 includes both an inner and outer chamfer. In this example, an inner chamfer 41 is manufactured with a pass through in the injection molding tooling, such as by passing through an aperture or pass-through slot 50 formed in the top deck surface 30. In this example, there are a plurality of slots 50, specifically four formed pass-through slots 50. As shown in FIGS. 9A and 9B, the deck 12 also includes a radius perimeter 52. As illustrated, the radius perimeter allows for fluid, such as rain, to flow under the deck 12.

Figure 11A:
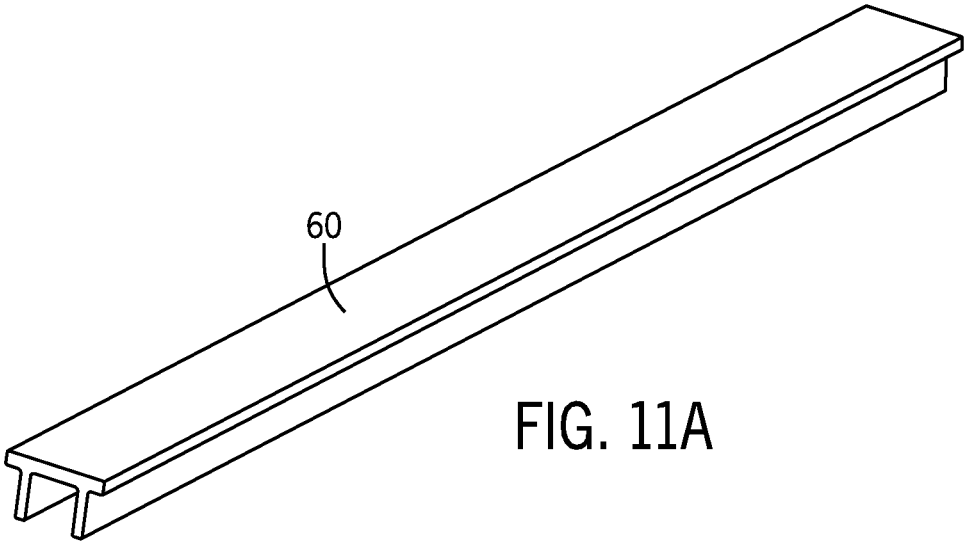
FIG. 11A is a perspective view of one of the example reinforcement rods of FIG. 10.
Figure 11B:
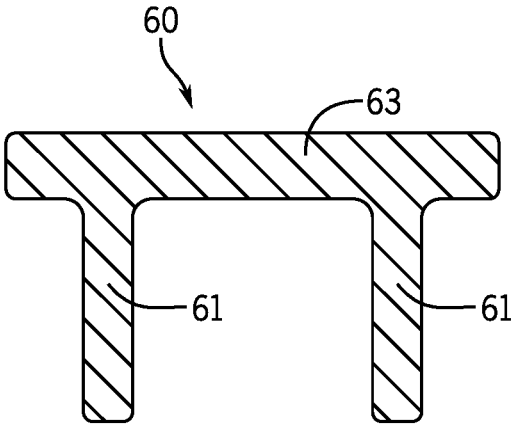
FIG. 11B is an end elevational view of the example reinforcement rod of FIG. 11A.

FIG. 11A illustrates a perspective view of an example reinforcement rod 60 that may be used with either of the reinforcement rod assemblies 14, 20. As shown in FIG. 11B, the reinforcement rods are generally "Pi-shaped" in cross section, with two flanges 61 extending from a central horizontal cross member 63.

Figure 24:
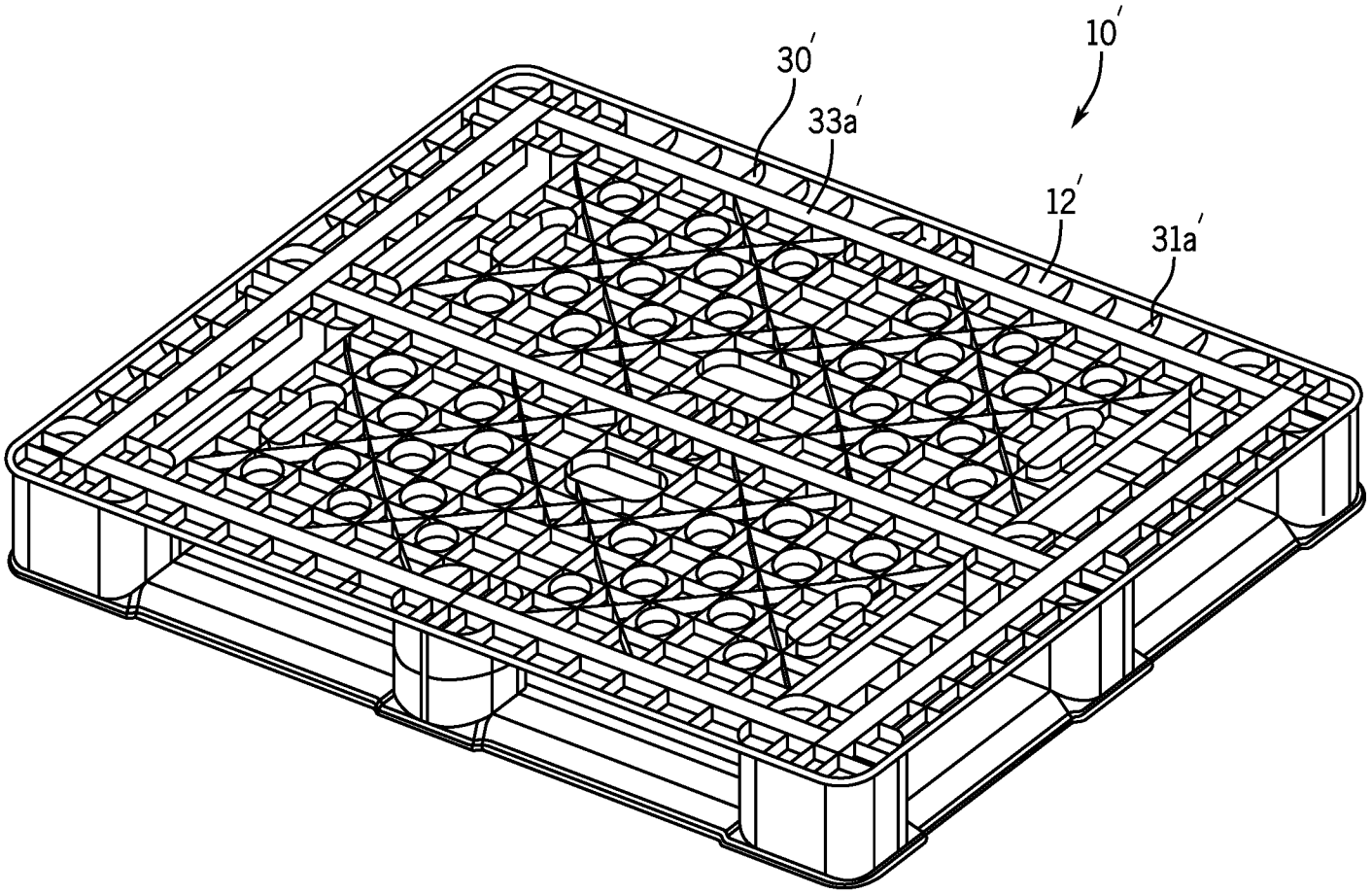
FIG. 24 is a top, perspective view of an example integrally formed injection molded deck for use in the example pallet of FIG. 22.
Figure 25:
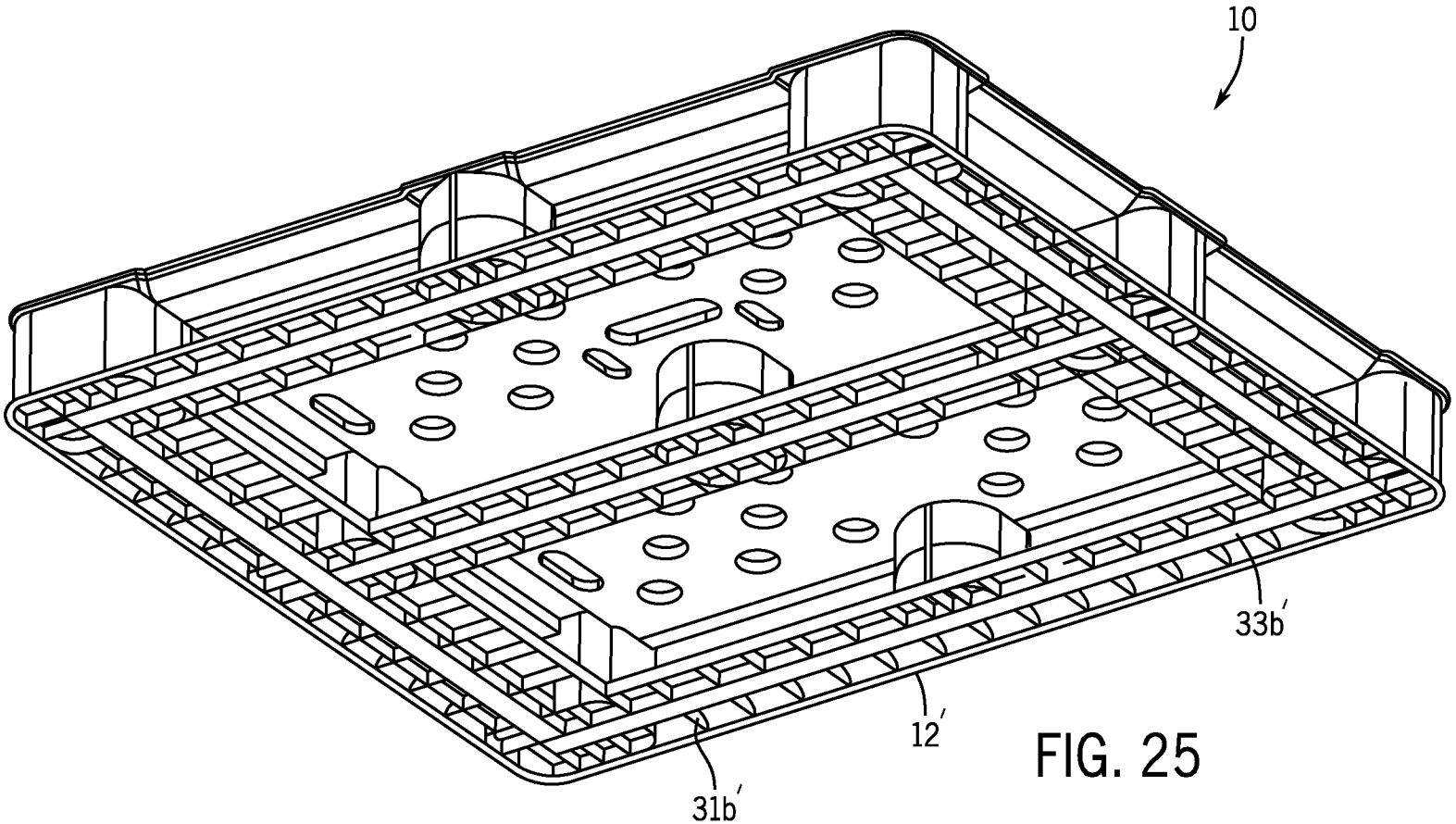
FIG. 25 is a bottom, perspective view of the example integrally formed injection molded deck of FIG. 24.

Moving to FIGS. 22-27, there is illustrated another example pallet 10' constructed in accordance with the teachings of the present invention. In this example, the pallet 10' includes a plurality of ventilation holes 210 formed through a top sheet 16' and a deck 12'. In addition, as best seen in FIG. 24, the deck 12' includes a plurality of outwardly extending ribs 31*a'* that are arranged in a different reinforcement pattern than the ribs 31*a* in the pallet 10, thereby accommodating the ventilation holes 210 (see FIG. 4). The example deck 12' similarly includes at least one channel 33*a'* to accommodate various reinforcement rods, such as for example the reinforcement rod assembly 14 as previously disclosed. In a similar manner, the bottom of the deck 12' includes a plurality of outwardly extending ribs 31*b'* and at least one channel 33*b'* to, once again, accommodate various reinforcement rids, such as for instance the reinforcement rob assembly 18.

Figure 26:
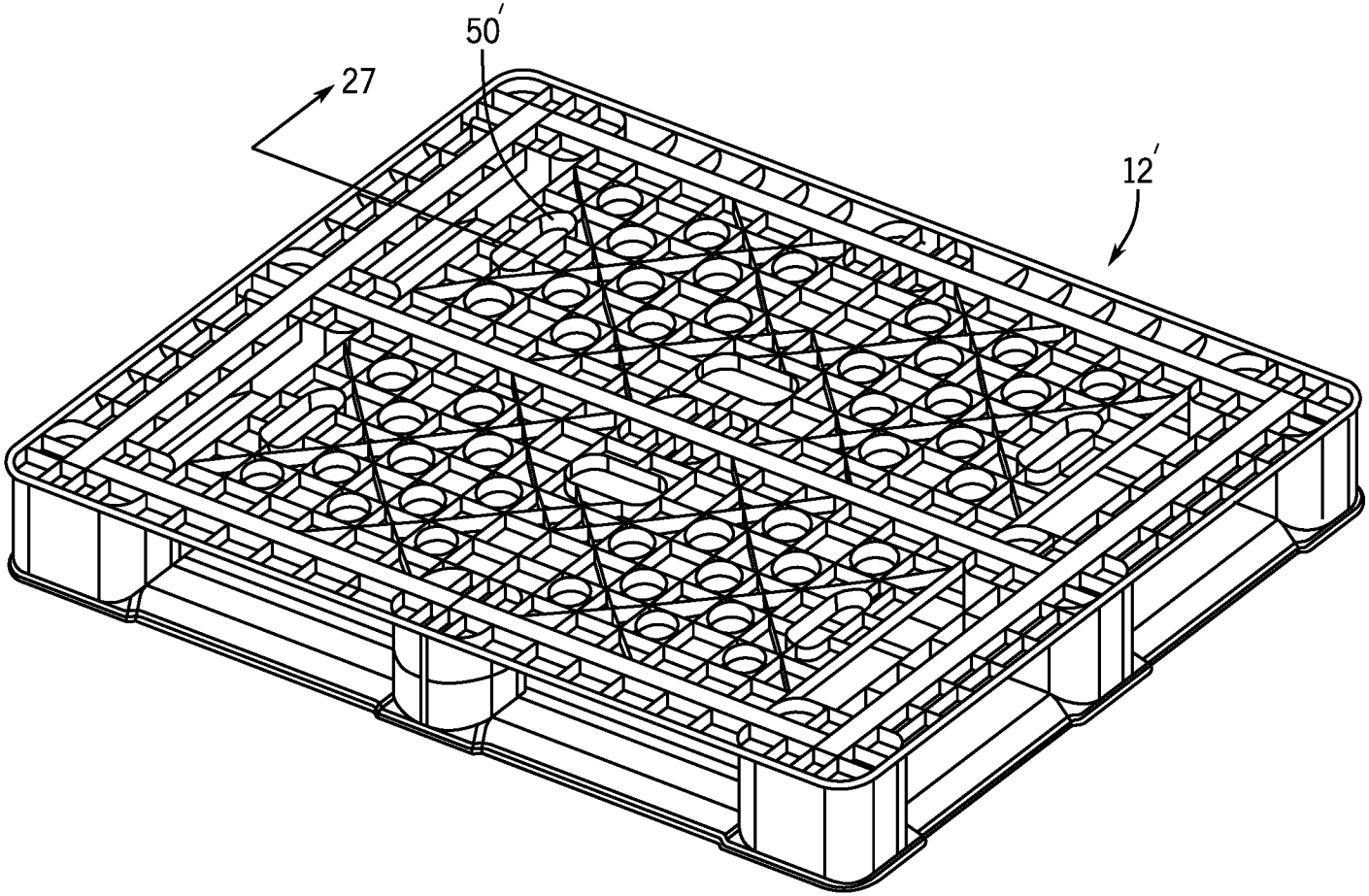
FIG. 26 is another top, perspective view of the example deck of FIG. 24.
Figure 27:
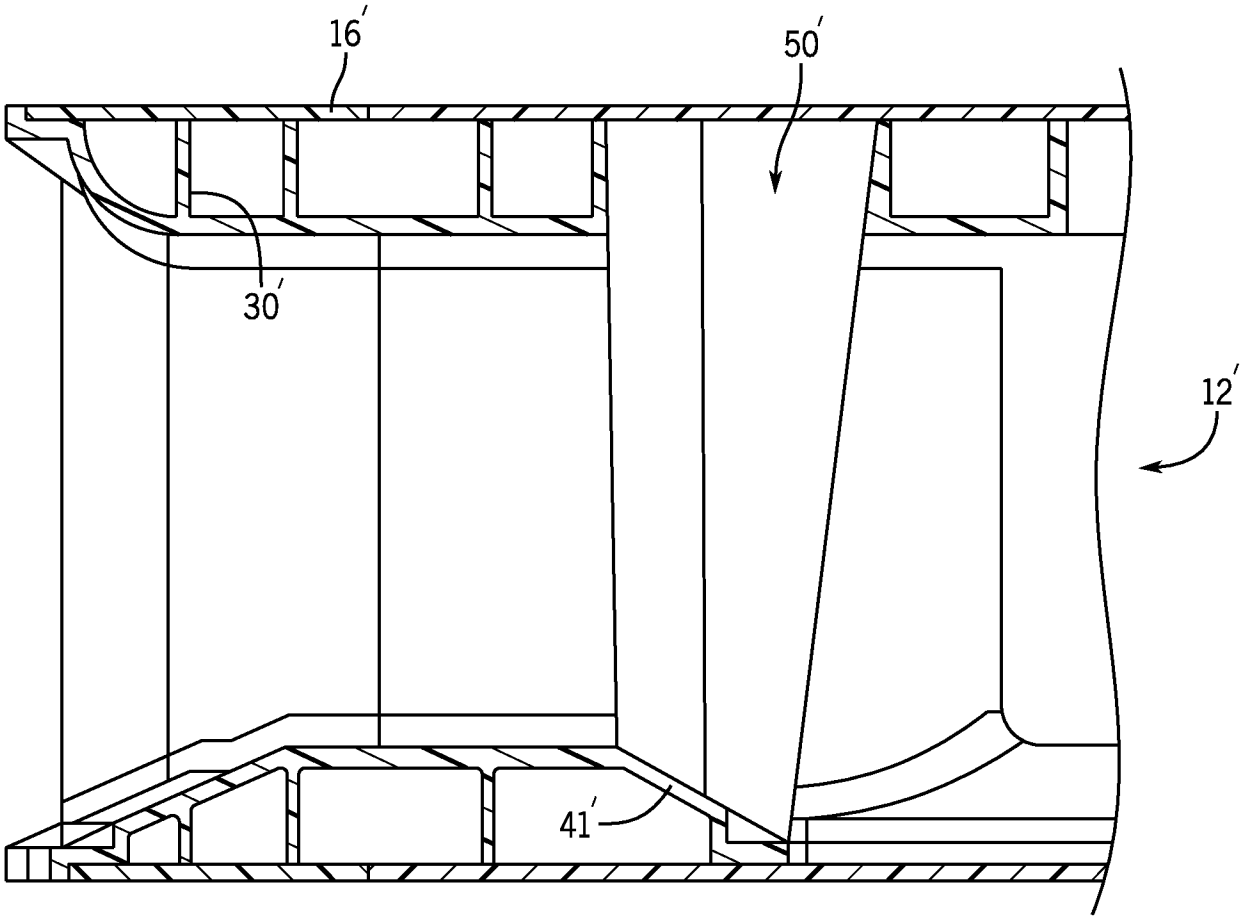
FIG. 27 is an enlarged cross-sectional view of the example deck taken along line 27-27 of FIG. 26.

As shown in FIGS. 26 and 27, the deck 12' likewise includes both an inner and outer chamfer. In this example, an inner chamfer 41' is manufactured via a pass through in the injection molding tooling, such as by passing through an aperture or pass-through slot 50' formed, once again, in a top deck surface 30'. In this example, there are a plurality of slots 50', specifically four formed pass-through slots 50'. As shown in FIGS. 9A and 9B, the deck 12 also includes a radius perimeter 52. As illustrated, the radius perimeter allows for fluid, such as rain, to flow under the deck 12.

Figure 12:
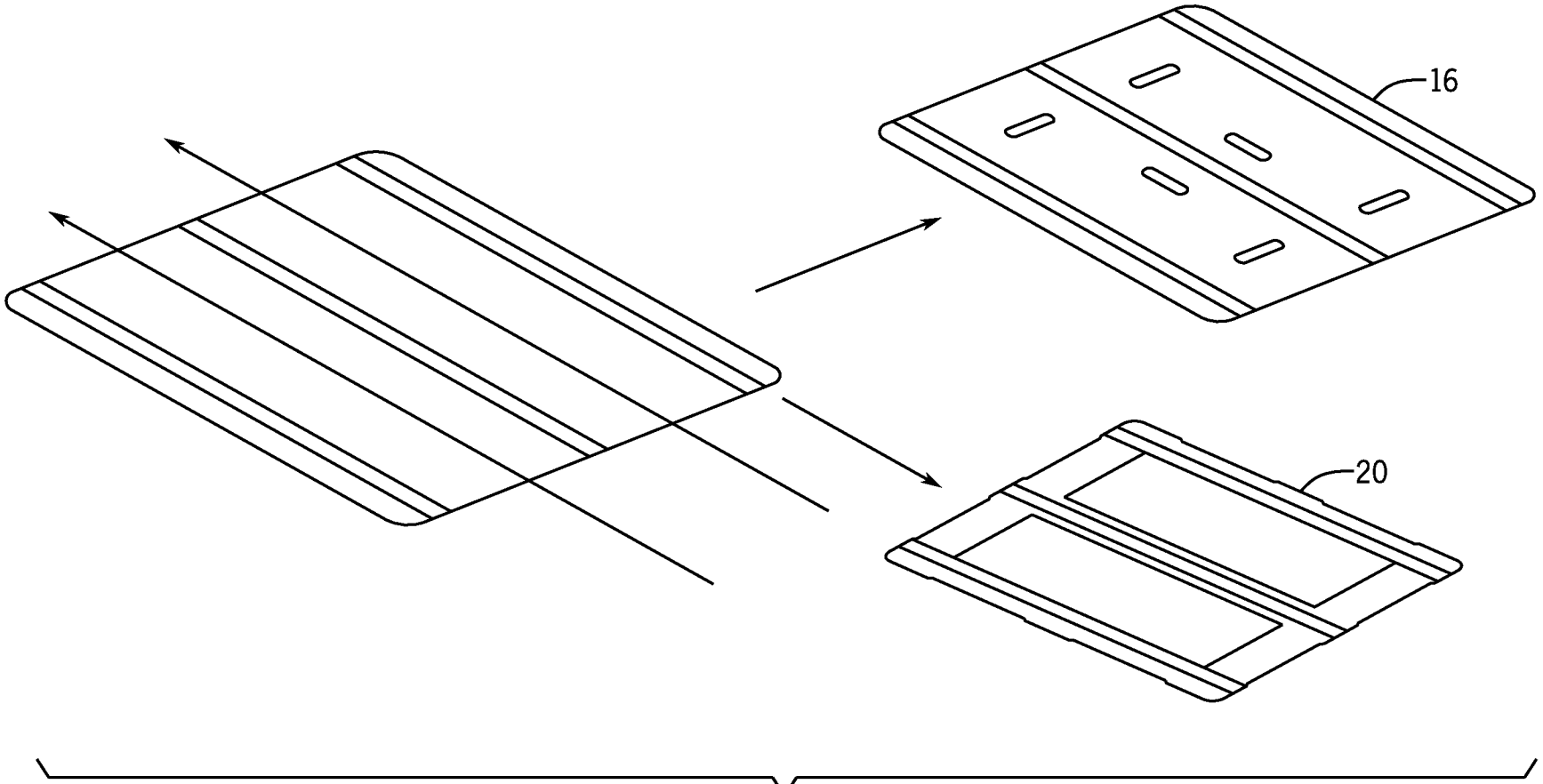
FIG. 12 is an illustration of an example method of manufacturing the top sheet and bottom sheet of the example pallet.
Figure 13:
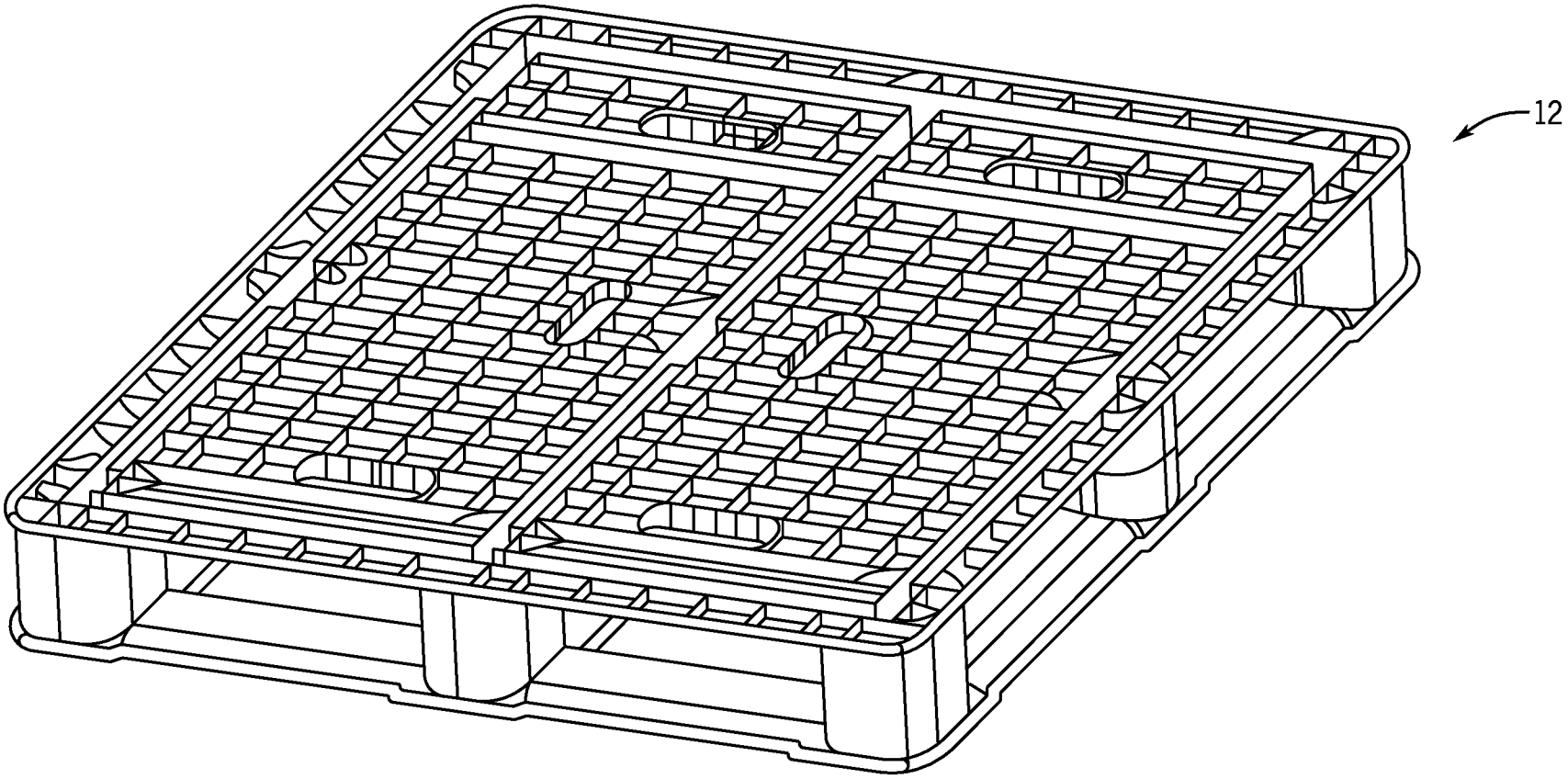
FIG. 13 is an illustrated example step in the method of injection molding the deck.

Returning now to FIGS. 12-21, there is shown one example method of manufacturing the pallet 10 and the various component assemblies. While the present manufacturing methodology is disclosed with reference to the pallet 10, it will be appreciated that the manufacturing techniques and methodologies detailed herein are applicable to any suitable pallet, including pallet 10', as desired. For example, FIG. 12 illustrates that the top sheet 16 and the bottom sheet 20 may be extruded and may include various non-slip surfaces. For example, as constructed, the top of the pallet 10 promotes resistance to slipping against a payload without components protruding from the pallet 10, such as a grommet or molded lip. Similarly, the bottom of the pallet promotes resistance to slipping against the ground. Accordingly, as illustrated, the example top sheet 16 and bottom sheet 20 are extruded with co-extruded TPE strips to provide a non-slip surface with a low profile.

Figure 14:
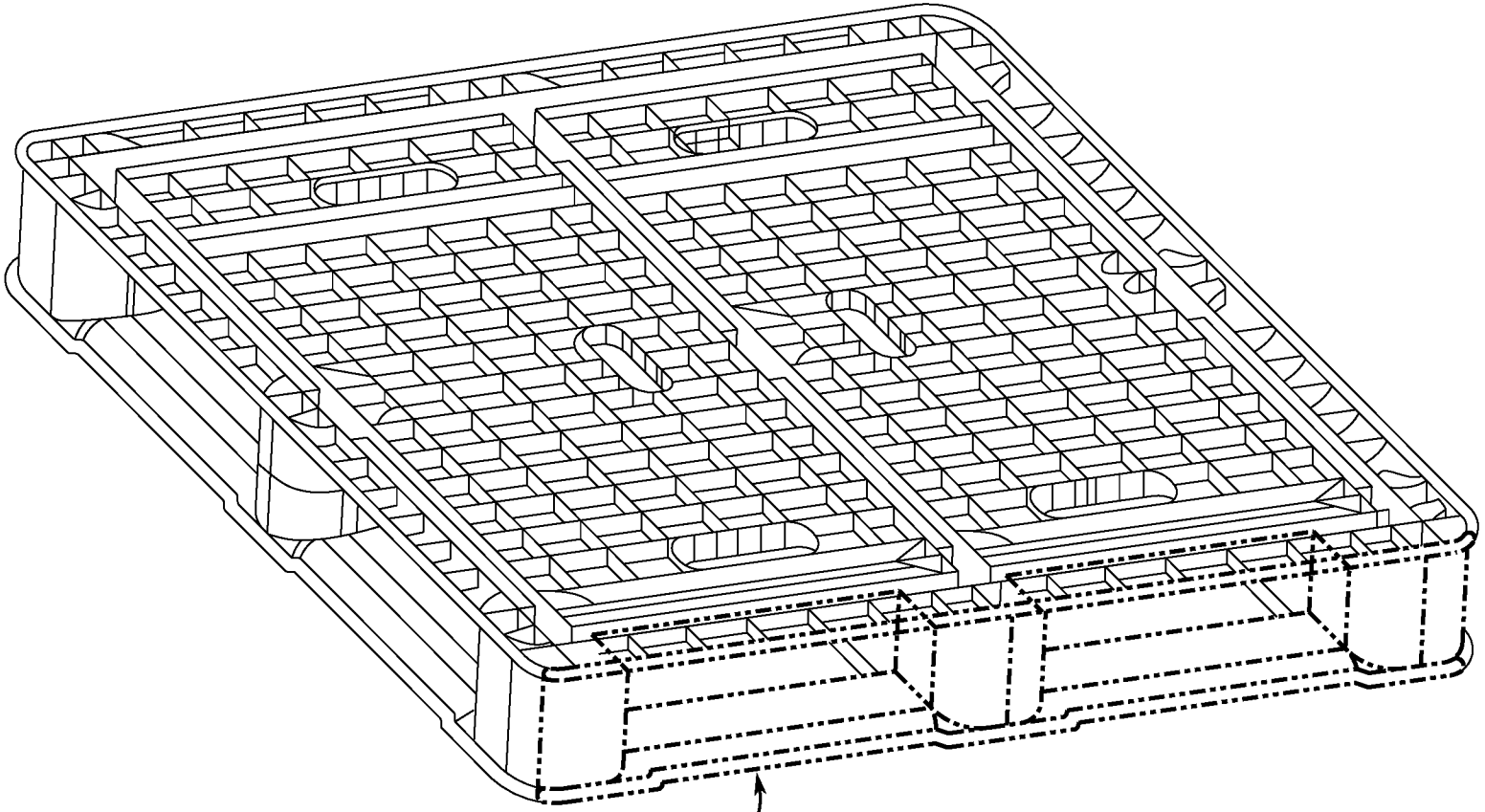
FIG. 14 is another example step in the method of injection molding the deck.
Figure 15:
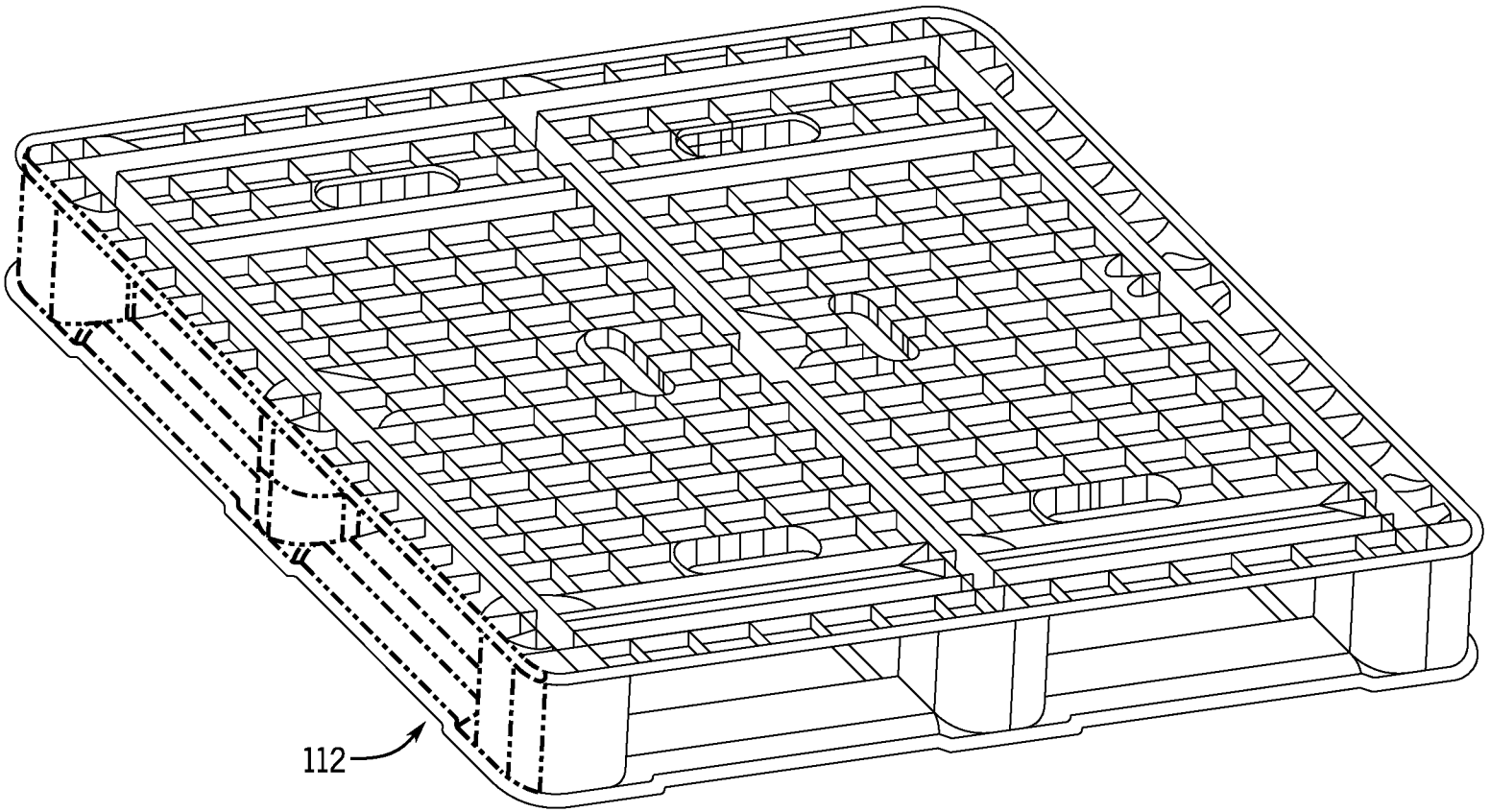
FIG. 15 is another example step in the method of injection molding the deck.

FIGS. 13-17B together illustrate an example method of molding the unitary deck 12. It will be appreciated by one of ordinary skill in the art that in general, the deck 12 is molded with a traditional molding process. However, in the present example, a few modifications to the design of the deck 12 allow for various manufacturing techniques and allow for a single form deck. For instance, as illustrated in FIG. 14, features 110 shown are manufactured by side action outside the perimeter of the deck 12 of the pallet 10. The same process may be employed for the opposite side of the deck 12. Further, as illustrated in FIG. 15, features 112 are similarly manufactured by side action outside of the deck 12 of the pallet 10. Once again, the same process may be employed for the opposite side of the deck 12.

Figure 16A:
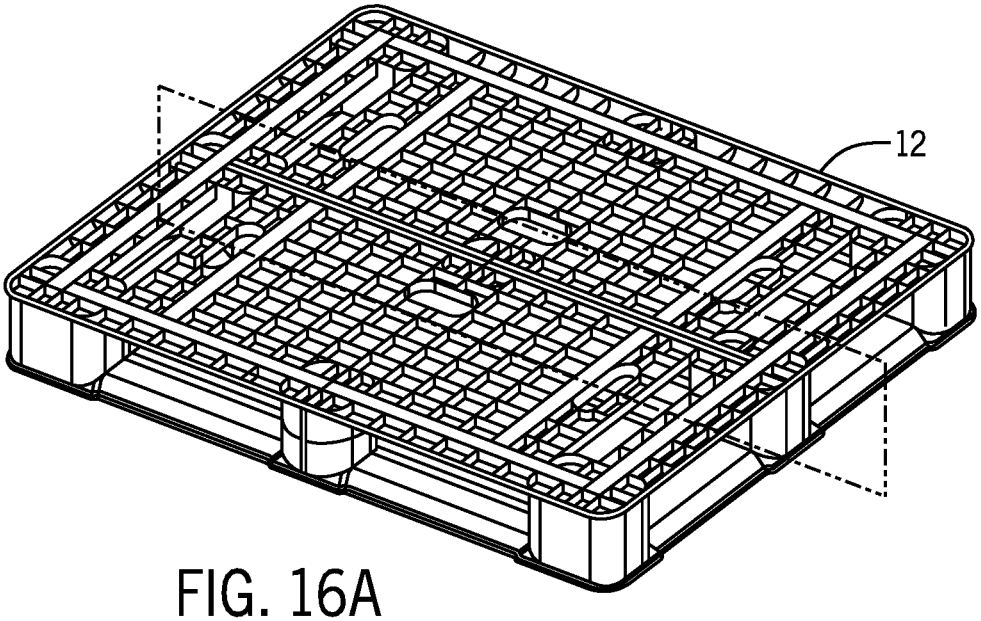
FIGS. 16A-16C together illustrate another example manufacturing step of the deck.
Figure 16B:
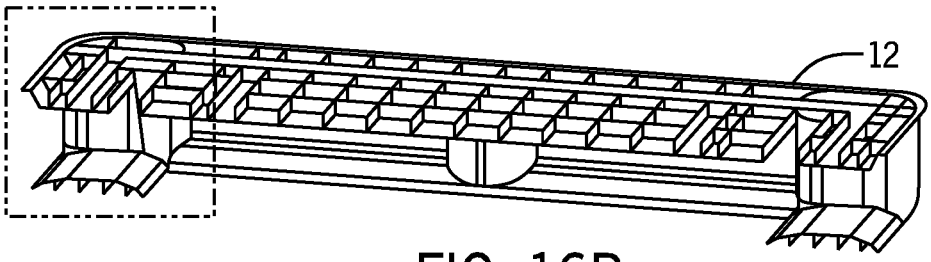
Figure 16C:
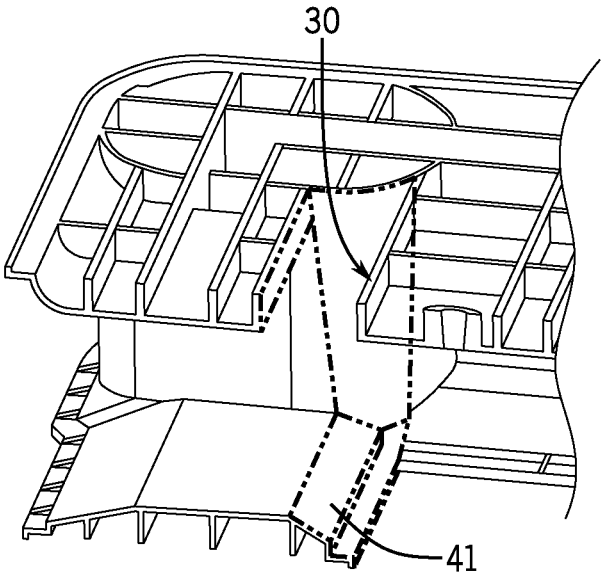
Figure 17A:
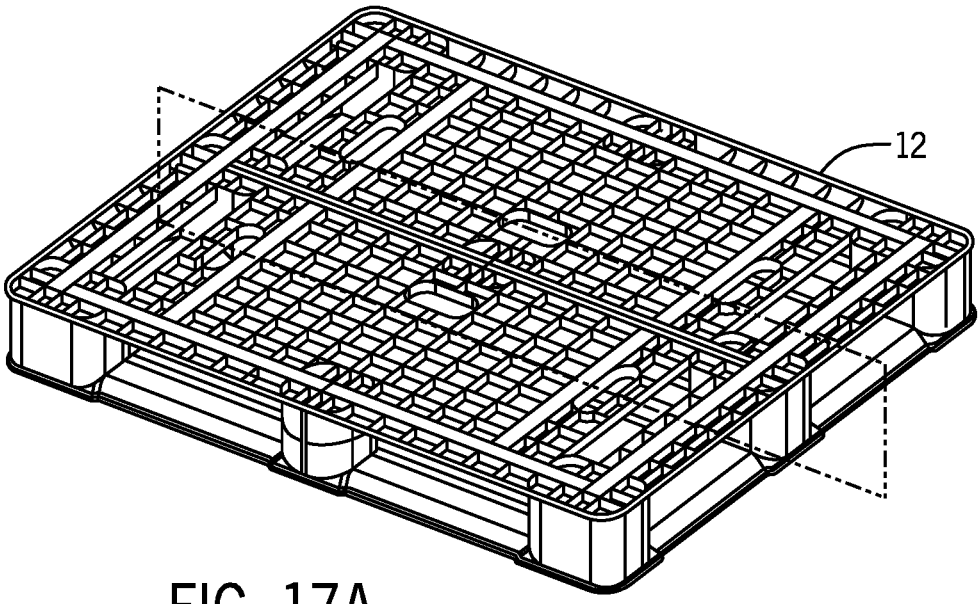
FIGS. 17A-17B together illustrate another example manufacturing step of the deck.
Figure 17B:
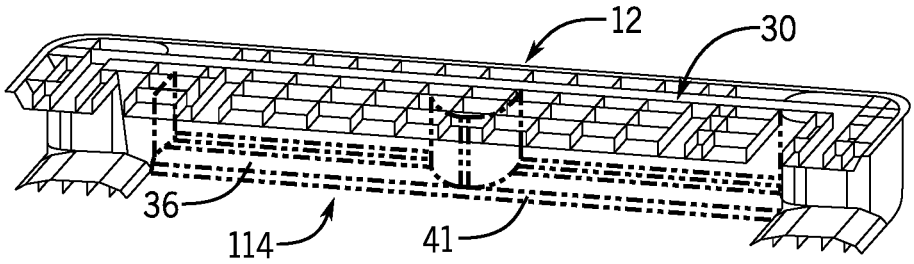

Turning to FIGS. 16A-16C, it will be appreciated that the lower chamfers, and in particular the inside chamfers 41 is manufactured with a pass through in the injection molding tooling, such as by passing through the pass-through slots 50 formed in the top deck surface 30. In addition, a transverse region 114 is made using a sliding tool action during injection molding after the top of the mold is lifted from the deck 12 to create the inner chamfer 41 on the inner edge of the stringers 36. In this illustrated example, the tooling slides towards the center of the deck 12 upon part ejection.

Figure 18:
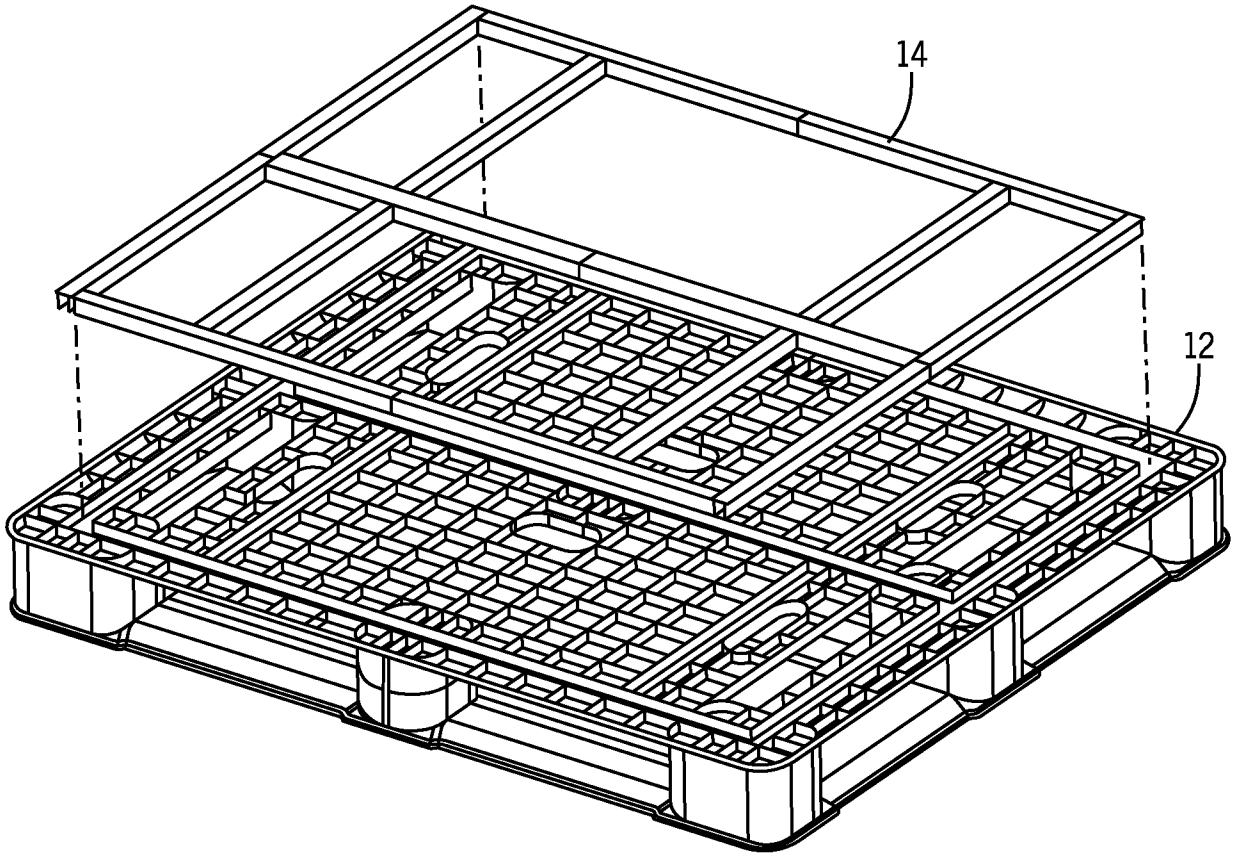
FIG. 18 is an illustration of an assembly step of the pallet showing the reinforcement rod placement.
Figure 19:
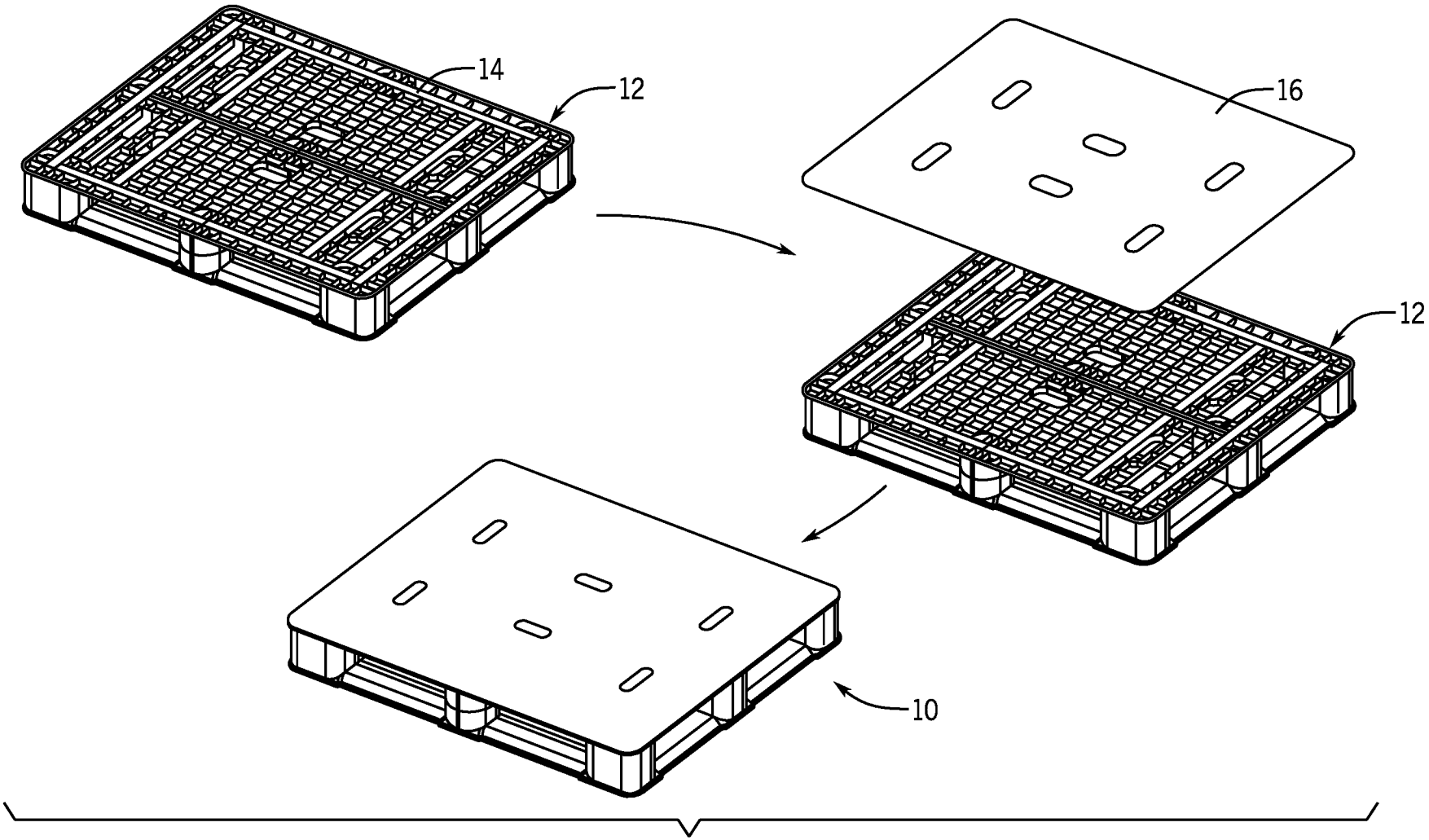
FIG. 19 is an illustration of an assembly step of the pallet showing the welding of the top sheet.

Turning to FIG. 18, once the deck 12 is unitarily formed, the top reinforcement rod assembly 14 is inserted into a reciprocal slot formed in the top of the deck 12. Then, as shown in FIG. 19, the top sheet 16 is attached to the top of the deck 12, such as by welding, to enclose the deck 12 and to prevent the top reinforcement rod assembly 14 from dislodging.

Figure 20:
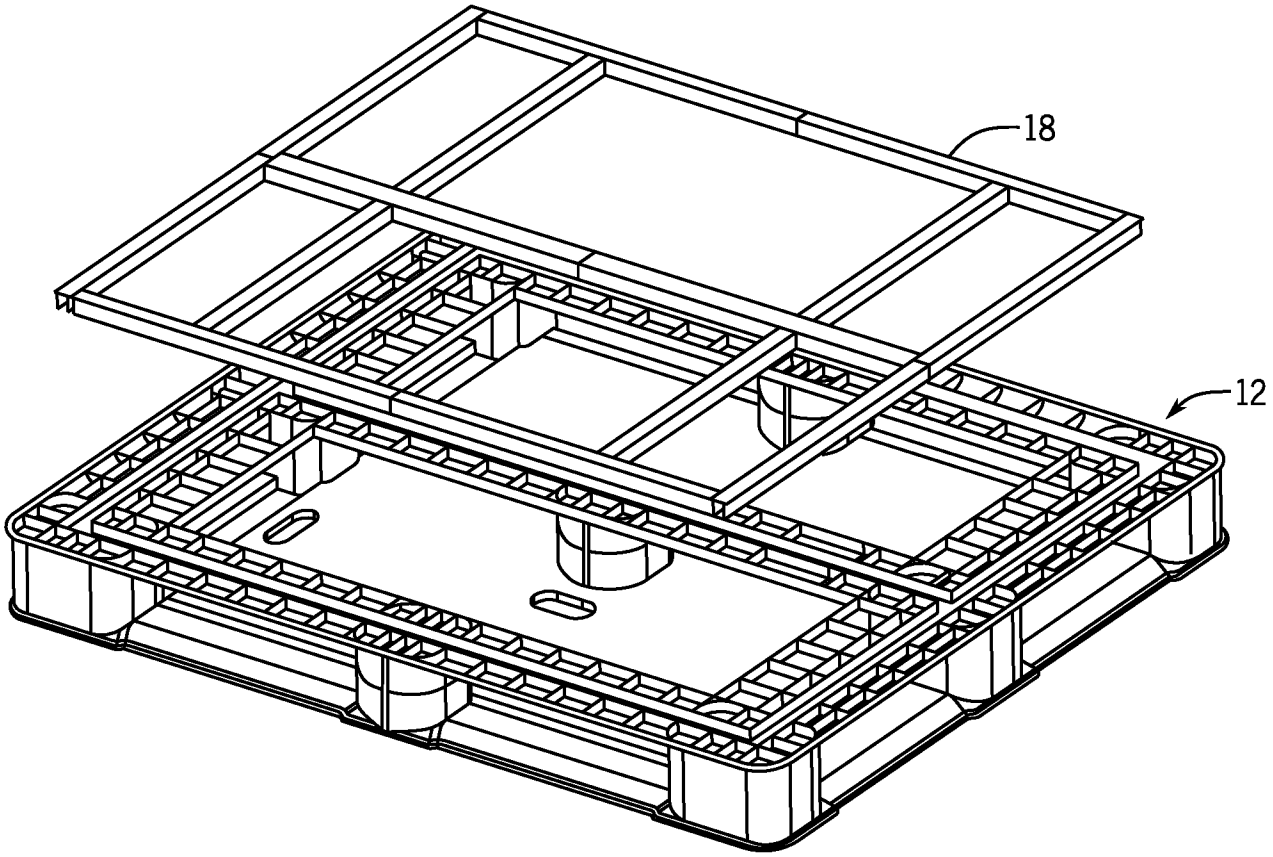
FIG. 20 is an illustration of an assembly step of the pallet showing additional reinforcement rod placement.
Figure 21:
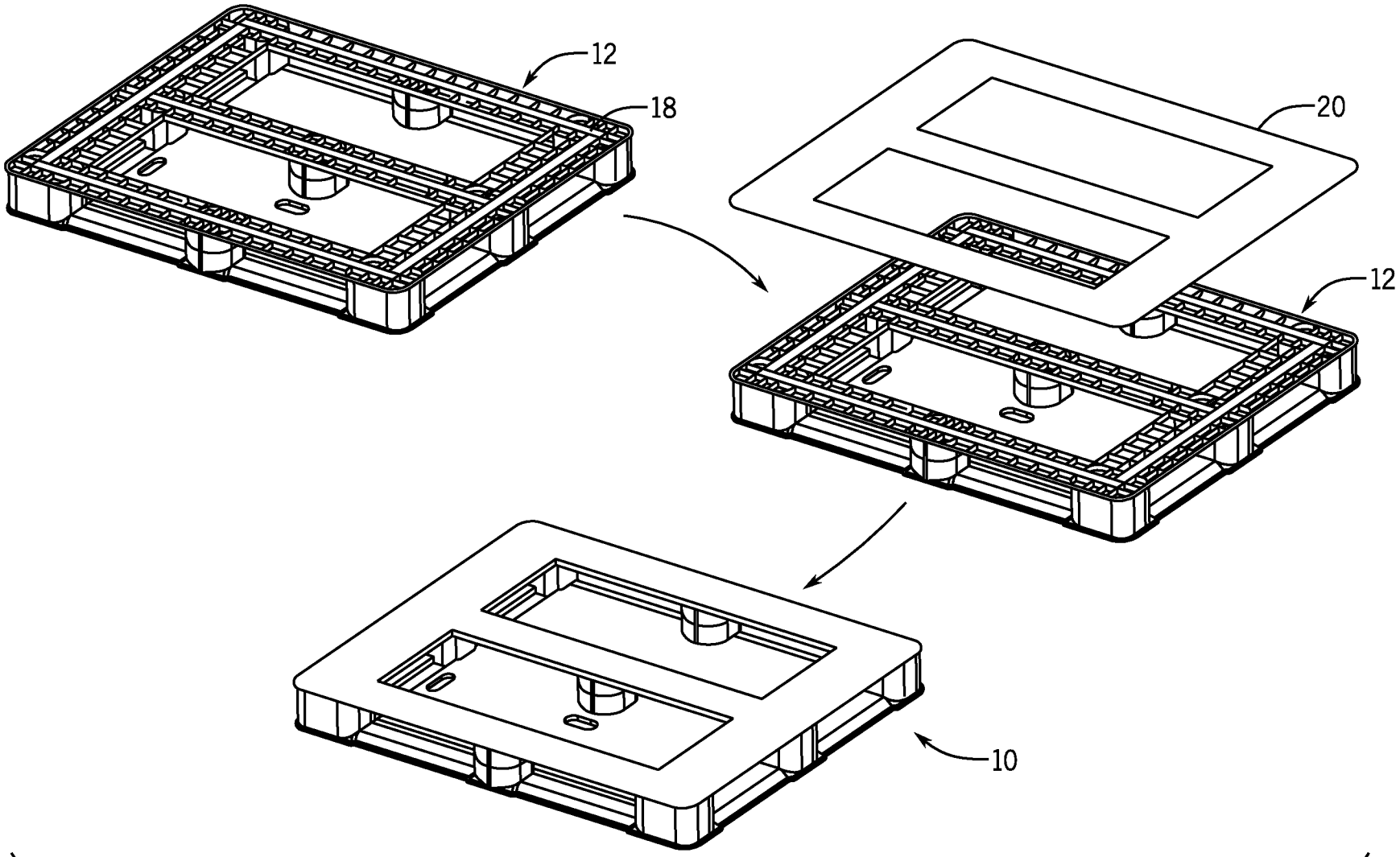
FIG. 21 is an illustration of an assembly step of the pallet showing the welding of the bottom sheet.
Figure 22:
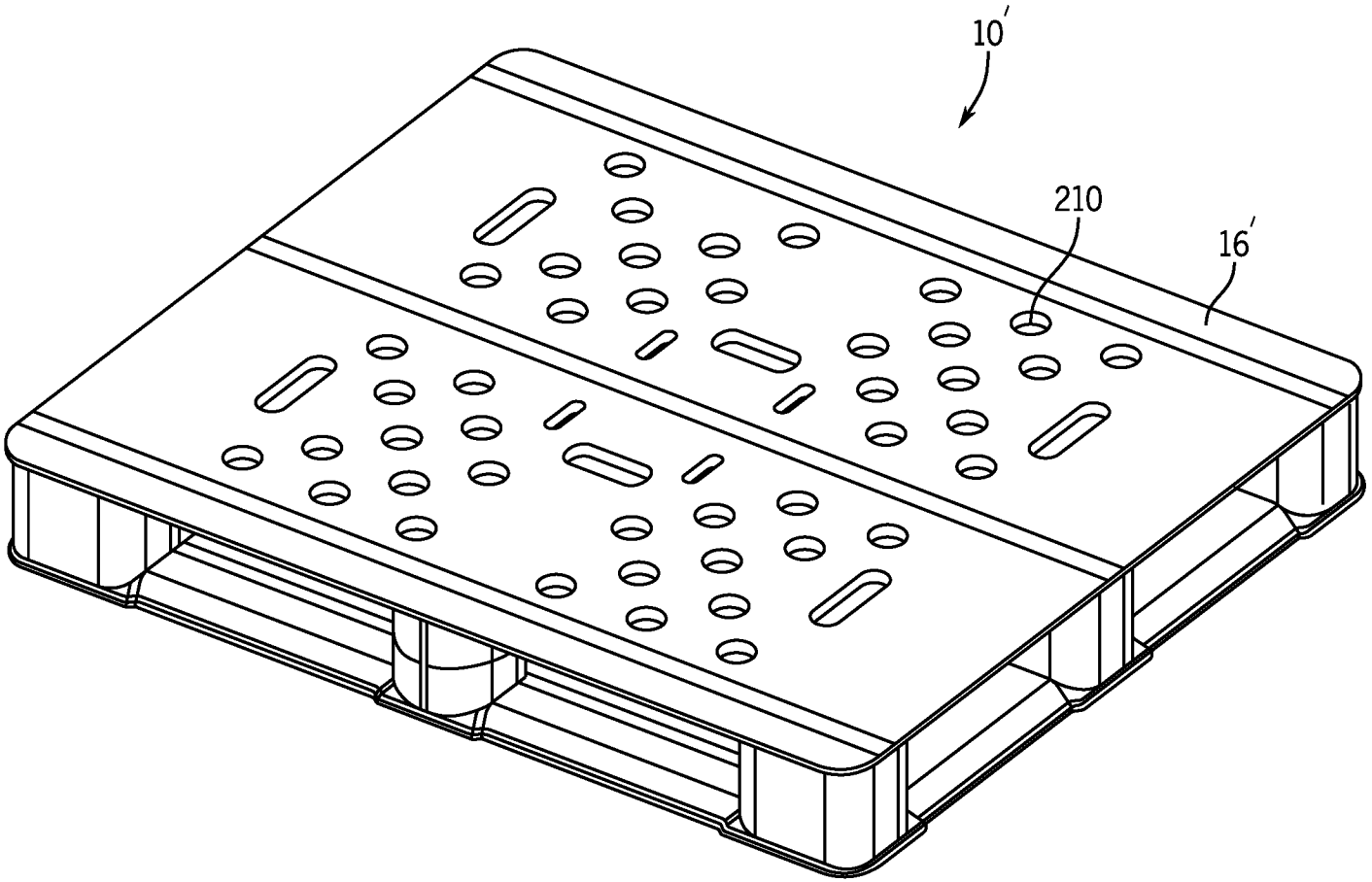
FIG. 22 is a top, perspective view of an example plastic pallet constructed in accordance with the teachings of the present disclosure.
Figure 23:
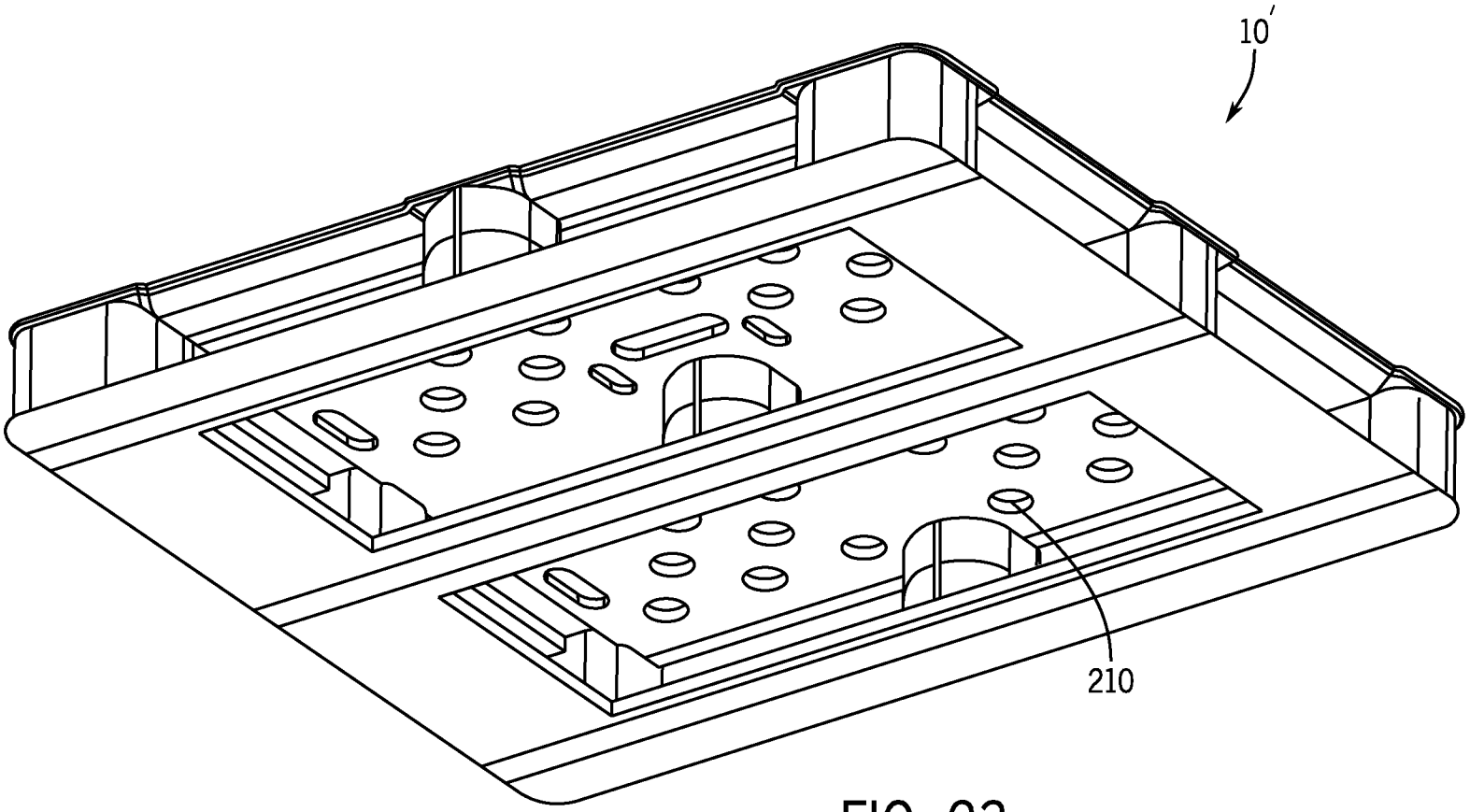
FIG. 23 is a bottom, perspective view of the example pallet of FIG. 22.

Once the top sheet 16 is attached, the partially assembled pallet is flipped over and the bottom reinforcement rod assembly 18 is inserted into a reciprocal slot formed in the bottom of the deck 12 as illustrated in FIG. 20. Then, as shown in FIG. 21, the bottom sheet 20 is attached to the bottom of the deck 12, such as by welding, to enclose the bottom of the deck 12 and to prevent the bottom reinforcement rod assembly 18 from dislodging, finally resulting in the fully assembled pallet 10.

It will be appreciated that in certain applications it is beneficial, if not required, for pallets to resist burning in the event of a fire and to that end, prior art pallets have been treated with fire retardant material. In the case of plastic pallets it is known to incorporate a fire retardant chemical into the plastic that is ultimately injection molded. One downside is the high cost of fire retardant chemicals, substantial quantities of which are required if included in the plastic itself. According, in one example of the present disclosure, only the top sheet 16 is treated with a fire retardant material. In another example, only the bottom sheet 20 is treated with a fire retardant material. It is further contemplated that the amount and even type of fire retardant material used with the top sheet 16 may differ from that used for the bottom sheet 20. While it is envisioned that the fire retardant would be incorporated directly into the plastic material forming the top and bottom sheets, other means of applying or treating these components are considered within the scope of the present disclosure. Accordingly, the pallet according to the present invention may possess the required fire retardant qualities without the necessity of treating the deck 12 and thereby saving material and cost.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A reinforced plastic pallet comprising:

a unitary deck formed in a molding process, the unitary deck comprising a top deck surface, a bottom deck surface, a plurality of spaced apart supports extending between the top deck surface and the bottom deck surface, and a plurality of stringers extending between adjacent ones of the plurality of spaced apart supports and forming a portion of the bottom deck surface, the top deck surface having a plurality of outwardly extending top ribs extending from the top deck surface and the bottom deck surface having a plurality of outwardly extending bottom ribs extending from the bottom deck surface;

a separately formed top sheet coupled to the top deck surface and enclosing the plurality of outwardly extending top ribs between the top sheet and the top deck surface; and a separately formed bottom sheet coupled to the bottom deck surface and enclosing the plurality of outwardly extending bottom ribs between the bottom sheet and the bottom deck surface, wherein at least one of the plurality of stringers along a perimeter of the bottom deck surface comprises a trailing edge chamfer, unitarily formed with the at least one of the plurality of stringers, and wherein the top deck surface defines a pass-through slot extending through the top deck surface and vertically aligned with the trailing edge chamfer, the slot being configured to allow a tool to pass through the slot during manufacturing of the unitary deck to form the trailing edge chamfer.

2. The reinforced plastic pallet of claim 1, wherein at least one of the top sheet is welded to the top deck surface or the bottom sheet is welded to the bottom deck surface.

3. The reinforced plastic pallet of claim 1, wherein the trailing edge chamfer is approximately 21°.

4. The reinforced plastic pallet of claim 1, wherein the top deck surface defines a channel formed within the plurality of outwardly extending ribs.

5. The reinforced plastic pallet of claim 4, further comprising a reinforcement rod supported within the channel.

6. The reinforced plastic pallet of claim 5, wherein the reinforcement rod is fully enclosed within the channel between the top deck surface and the top sheet.

7. The reinforced plastic pallet of claim 5, wherein the reinforcement rod comprises at least one flange extending generally perpendicular from a central crossmember.

8. The reinforced plastic pallet of claim 7, wherein the reinforcement rod is generally "pi-shaped" in cross section.

9. The reinforced plastic pallet of claim 5, wherein the reinforcement rod is formed from a substantially rigid material.

10. The reinforced plastic pallet of claim 1, further comprising a plurality of defined ventilation holes extending through the top sheet and the top deck surface.

11. The reinforced plastic pallet of claim 1, wherein at least a portion of a perimeter of the top deck surface comprises a radiused edge opposite the top deck.

12. The reinforced plastic pallet of claim 1 further comprising at least one grip surface coupled to the at least one of the top sheet or the bottom sheet.

13. The reinforced plastic pallet of claim 12, wherein the at least one grip surface is a Thermoplastic Elastomer.

14. The reinforced plastic pallet of claim 13, wherein the top deck is extruded during manufacture and the Thermoplastic Elastomer is coextruded with the top deck.

15. The reinforced plastic pallet of claim 1, wherein at least a portion of the deck, the top sheet, or the bottom sheet comprises a fire retardancy component.

16. The reinforced plastic pallet of claim 15, wherein the fire retardancy component is an additive to the plastic pallet.

17. The reinforced plastic pallet of claim 1, wherein the unitary deck is formed via a single injection molding process.

* * * * *